US011437730B2

(12) United States Patent
Hung

(10) Patent No.: US 11,437,730 B2
(45) Date of Patent: Sep. 6, 2022

(54) PATCH ANTENNAS WITH EXCITATION RADIATOR FEEDS

(71) Applicant: HEWLETT-PACKARD DEVELOPMENT COMPANY, L.P., Spring, TX (US)

(72) Inventor: Kuan-Jung Hung, Taipei (TW)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/965,110

(22) PCT Filed: Apr. 5, 2018

(86) PCT No.: PCT/US2018/026207
§ 371 (c)(1),
(2) Date: Jul. 27, 2020

(87) PCT Pub. No.: WO2019/194805
PCT Pub. Date: Oct. 10, 2019

(65) Prior Publication Data

US 2021/0013620 A1 Jan. 14, 2021

(51) Int. Cl.

| | |
|---|---|
| ***H01Q 9/04*** | (2006.01) |
| ***H01Q 9/30*** | (2006.01) |
| ***H01Q 19/26*** | (2006.01) |
| ***H01Q 1/48*** | (2006.01) |

(52) U.S. Cl.
CPC ..... *H01Q 19/26* (2013.01); *H01Q 1/48* (2013.01); *H01Q 9/0457* (2013.01); *H01Q 9/30* (2013.01)

(58) Field of Classification Search
CPC ..... H01Q 19/26; H01Q 9/04; H01Q 9/0407; H01Q 9/0457; H01Q 9/30; H01Q 9/40; H01Q 1/38
See application file for complete search history.

(56) References Cited

U.S. PATENT DOCUMENTS

| | | | | |
|---|---|---|---|---|
| 5,861,854 | A * | 1/1999 | Kawahata | H01Q 9/0407 343/702 |
| 7,072,690 | B2 | 7/2006 | Shin | |
| 7,817,094 | B2 * | 10/2010 | Adachi | H01Q 1/38 343/702 |
| 9,614,276 | B2 * | 4/2017 | Pinto | H01Q 1/243 |
| 10,320,077 | B2 * | 6/2019 | Chiou | H01Q 5/30 |
| 2005/0104788 | A1 | 5/2005 | Hung | |
| 2008/0001831 | A1 * | 1/2008 | Park | H01Q 1/245 343/702 |
| 2009/0091502 | A1 | 4/2009 | Wen | |

(Continued)

FOREIGN PATENT DOCUMENTS

| | | | |
|---|---|---|---|
| CN | 200953377 | Y | 9/2007 |
| CN | 105609925 | A | 5/2016 |

*Primary Examiner* — Jason Crawford
(74) *Attorney, Agent, or Firm* — Austin Rapp

(57) ABSTRACT

Examples of a patch antenna are described herein. Some examples of the patch antenna include a parallelepipedal antenna holder. In some examples, a first excitation surface is situated on a first side of the antenna holder, where a second side opposite the first side is situated on a metal plane. A grounding surface is situated on a third side between the first side and the second side. An excitation radiator feed is situated to provide electromagnetic coupling between the excitation radiator feed and the first excitation surface.

15 Claims, 27 Drawing Sheets

(56) References Cited

U.S. PATENT DOCUMENTS

| | | | | |
|---|---|---|---|---|
| 2010/0123640 | A1* | 5/2010 | Hui | H01Q 1/242 700/86 |
| 2011/0285599 | A1 | 11/2011 | Smith | |
| 2012/0206302 | A1 | 8/2012 | Ramachandran | |
| 2014/0313099 | A1* | 10/2014 | Pajona | H01Q 5/50 343/852 |
| 2015/0311594 | A1* | 10/2015 | Zhu | H01Q 21/28 343/702 |
| 2017/0288295 | A1 | 10/2017 | Sultenfuss | |
| 2018/0219275 | A1* | 8/2018 | Deng | H01Q 1/48 |
| 2020/0119436 | A1* | 4/2020 | Hung | H01Q 9/42 |
| 2021/0013620 | A1* | 1/2021 | Hung | H01Q 1/48 |

* cited by examiner

PATCH ANTENNAS WITH EXCITATION RADIATOR FEEDS

BACKGROUND

Electronic devices, such as laptops and cellular phones, include antennas for wireless communication. Such antennas may be mounted in an enclosure or housing of the electronic device. The antennas enable communication of electronic devices with wireless networks and satellite navigation systems.

DETAILED DESCRIPTION

Figure 1:
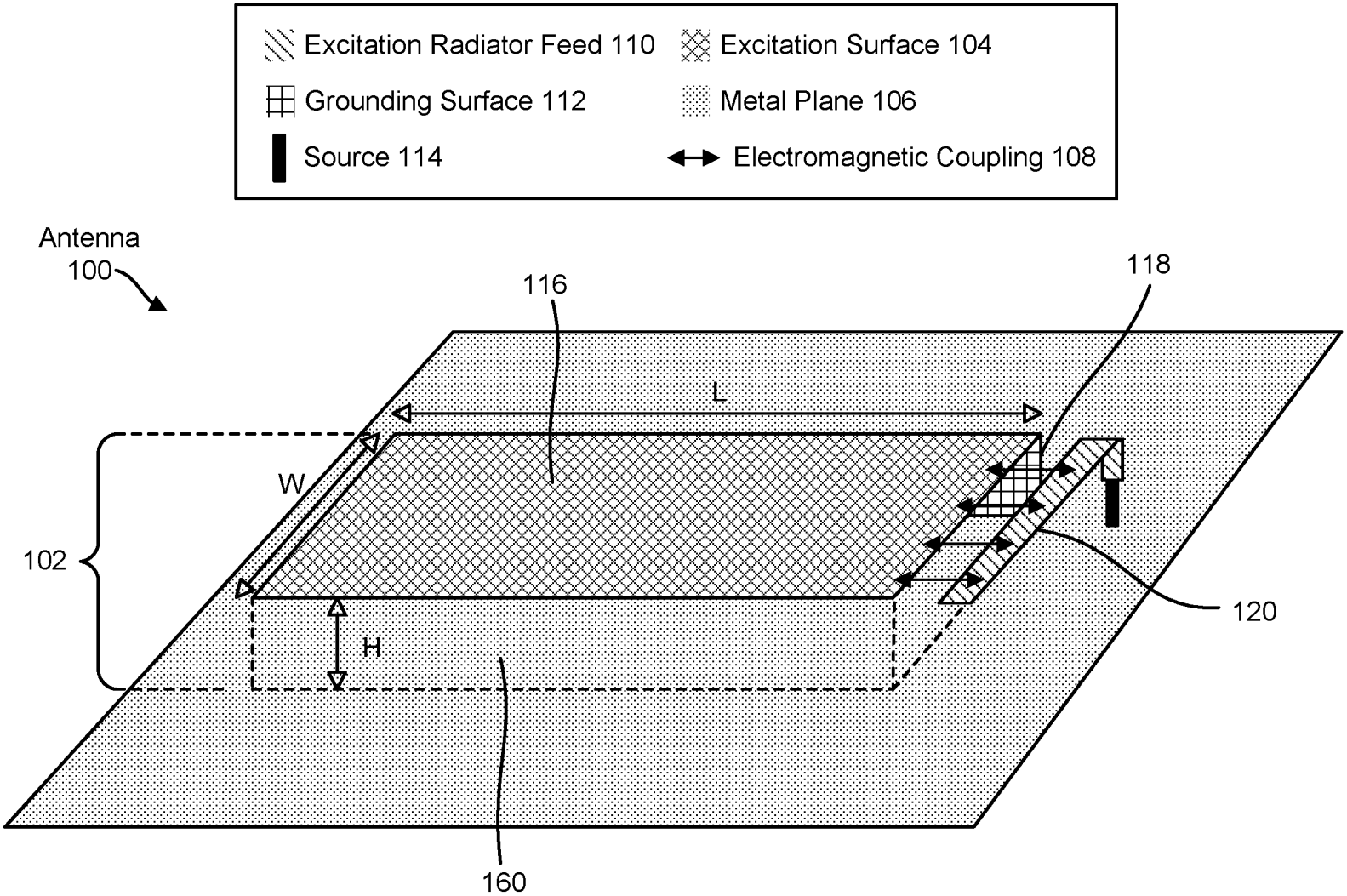
FIG. 1 illustrates a perspective view of an example of an antenna with a monopole excitation radiator feed.

Electronic devices have an enclosure in which electronic components, such as a processor, a memory, a power source, a cooling fan, an input/output (I/O) port, or the like, may be housed. Electronic devices also include a display unit for rendering visual output. The enclosure may be coupled to the display unit through a coupling element, such as a hinge. In an example, the electronic device may be a laptop having a keyboard in the enclosure and a display panel in the display unit.

As the enclosure houses a wide variety of electronic components, the enclosure may be space constrained. A wireless antenna may be generally mounted within the enclosure along with the other electronic components. While positioning the antenna in the enclosure, certain pre-defined clearances may be maintained between the antenna and other electronic components so that radiations from the antenna do not interfere with functioning of the other components. Positioning the antenna within the enclosure may also result in increased enclosure thickness and/or increase in specific absorption rate (SAR) associated with the radiations from the antenna at the bottom part of the enclosure. This may result in over heating of the bottom part of the enclosure of the electronic device.

Some electronic devices may have enclosures for achieving a metallic looking form factor. For example, the enclosure may have some portions made of metal. Antennas may be mounted in a slot provided within the metal portion of the enclosure. The slot for the antenna, which may be an antenna window, may be a cut-out in the metal portion. The antenna may be placed in the slot and then the slot may be covered with a plastic filling member. The radiations from the antenna may be transmitted through walls of the plastic filling member. The plastic filling member may be then coated with metal-finish paints to give the plastic filling member an appearance similar to the surrounding metal portion of the enclosure. Cutting a slot in the metal portion, positioning the antenna in the slot, covering the slot with the plastic filling member, and coating the plastic filling member with metal-finish paints involves additional material cost of the plastic filling member and the metal-finish paints and also involves additional production steps and production time.

Some examples of the antennas described herein may be implemented in a windowless enclosure (e.g., windowless metal case). Some examples may avoid the extra plastic window area and painting decorations. Additionally or alternatively, some examples may avoid extra base thickness and/or may avoid the SAR issue for clamshell and convertible devices.

Examples of antennas include shorted patch antennas. A shorted patch antenna includes a metal patch (e.g., plate, excitation surface, radiator, etc.) that may be shorted to ground. For shorted patch antennas, radiation may be mainly contributed from a slot mode created between two metal plates (e.g., radiator metal and a metal plane). Accordingly, when placed on a metal plane (such as a tablet metal cover or laptop display unit), the antennas can have lower antenna height and better radiation when compared to other radiator structures such as monopoles, planar inverted-F antennas (PIFAs), and loops.

A direct-feed antenna may be an antenna where the feed may be directly attached to the radiator. For example, a direct-feed patch antenna includes a patch that may be directly attached to the feed. For direct-feed shorted patch antennas, the feeding length size may be limited by the height of the antenna. The antenna height may be usually short for low-profile applications, which limits the feeding length, which in turn limits patch radiation.

Some examples of the antennas described herein enable extending the feeding length to improve radiation. For instance, an excitation radiator feed may be implemented that provides additional feeding length (besides the patch height) from the coupling length between the patch and the metal excitation radiator. Specifically, the excitation radiator feed may be electromagnetically coupled to a shorted patch of the antenna. Examples of the excitation radiator feed include monopoles, loops, and combinations of both.

Antenna size may be a concern in some electronic devices. Antenna size may be constrained by wavelength resonances in one or more bands of interest. Some examples of the antennas described herein utilize one or more extension arms to enable reducing antenna size while providing one or more resonances for the frequency bands of interest (e.g., 2.4 gigahertz (GHz) and 5 GHz for WLAN applications).

The following detailed description refers to the accompanying drawings. The same or similar reference numbers may be used in the drawings and the following description to refer to the same or similar parts. While several examples are described in the description, modifications, adaptations, and other examples are possible. Accordingly, the following detailed description does not limit the disclosed examples. Instead, the proper scope of the disclosed examples may be defined by the appended claims.

FIG. 1 illustrates a perspective view of an example of an antenna 100 with a monopole excitation radiator feed. The antenna 100 may be an example of a patch antenna. The antenna 100 includes an antenna holder 102. As shown in FIG. 1, the antenna holder 102 has a parallelepipedal structure. The parallelepipedal structure may include six sides, twelve edges, and eight vertices (e.g., corners at the intersection of three sides). When referring to antenna holders herein, the sides may be referred to as a first side, a second side (where the second side may be opposite from the first side) a third side (where the third side may be between the first side and the second side), a fourth side (where the fourth side may be opposite from the third side), a fifth side, and a sixth side (where the sixth side may be opposite from the fifth side). For convenience, the first side may be visualized as a top side, the second side may be visualized as a bottom side, the third side may be visualized as a back side, the fourth side may be visualized as a front side, the fifth side may be visualized as a right (or left) side, and the sixth side may be visualized as a left (or right) side. In cascaded structures the fifth sides of antenna holders may face each other (e.g., toward an "inside"). It should be noted that the antenna holders may be oriented in a variety of orientations and therefore the sides may be oriented in any orientation. The edges may or may not meet at right angles. A specific example of a parallelepipedal structure may be a cuboid, where each side may be rectangular and the edges meet at right angles.

The antenna holder 102 may be implemented with a variety of materials. In an example, the antenna holder 102 has walls formed from a plastic material, such as Polycarbonate/Acrylonitrile Butadiene Styrene (PC/ABS). The antenna holder 102 may be hollow or may contain a di-electric material within the plastic walls. In an example, the di-electric material contained within the walls of the plastic antenna holder may have a di-electric constant higher than plastic. In an example, a ceramic material may be contained within the walls of the plastic antenna holder, where ceramic has a di-electric constant higher than plastic. In some examples (for wireless local area network (WLAN) applications, for instance), the keep-out area dimensions (the length, width, and height of the antenna space in $mm^3$) may have a length 'L' in a range of about 25 millimeters (mm) to about 35 mm, a width 'W' in a range of about 8 mm to about 12 mm, and a height 'H' in a range of about 3.0 mm to about 4.5 mm. Some antennas (e.g., cascaded antenna structures) may have other dimensions (e.g., about 50-70 mm length). The dimensions may be determined to meet an antenna specification. The dimensions may fit into a variety of electronic devices, such as clamshell laptops, hybrid laptop/tablet devices, tablet devices, televisions, computers, vehicles, etc.

In some examples, one or more radiating elements, such as patches, slots, and/or monopoles may be formed on one or more surfaces of the antenna holder 102. A surface of the antenna holder 102 bearing one or more radiating elements may be referred to an excitation surface. One or more surfaces of the antenna holder 102 may be partly or fully coated with metal and may function either as excitation surfaces or ground surfaces. For example, the antenna holder 102 may be a substrate (e.g., a parallelepipedal substrate, a cuboid substrate, etc.) upon which one or more metal pieces may be situated or attached. In some examples of the antennas described herein, one or more radiating elements (e.g., excitation surfaces, metal patches, metal plates, etc.) may be implemented as a flexible printed circuit (FPC) antenna or a laser direct structuring (LDS) antenna.

In the example shown in FIG. 1, the antenna 100 includes an excitation surface 104 (e.g., metal patch) situated on a first side 116 (e.g., a top side) of the antenna holder 102. An excitation surface may be a metal surface configured to radiate electromagnetic energy. A second side (e.g., a bottom side) of the antenna holder 102 may be situated on (e.g., positioned on) a metal plane 106. The metal plane 106 may or may not be completely planar. In this example, the second side may be opposite the first side. A grounding surface 112 (e.g., a metal wall) may be situated on a third side 118 between the first side 116 and the second side (e.g., the bottom side, which may be on the metal plane 106). The grounding surface 112 may function to ground the excitation surface 104. The antenna 100 may be referred to as a "shorted" patch antenna due to the grounding.

In some examples, the antenna 100 may include an excitation radiator feed 110 (e.g., a metal feed strip) situated to provide electromagnetic coupling 108 between the excitation radiator feed 110 and the excitation surface 104. The excitation radiator feed 110 may be situated next to the excitation surface 104, and/or may not be in direct contact with the excitation surface 104. In the example shown in FIG. 1, the excitation radiator feed may be a monopole 120. In some examples of antennas described herein, an excitation radiator feed may be separated from an excitation surface by a distance between 0.5 millimeters (mm) and 1.0 mm. The monopole 120 may be a metal strip. In the example shown in FIG. 1, a first end of the monopole 120 (e.g., metal feed strip) may be coupled to a source 114 (e.g., a feeding signal source). All or a portion of the monopole 120 may be approximately coplanar with the excitation surface 104. In some examples, the second end of the monopole 120 may only extend to any length up to a side wall (e.g., to the front) of the antenna holder 102 and/or may not contact the metal plane 106. In other examples, the excitation radiator feed 110 may be structured differently. For example, the excitation radiator feed 110 may be a loop. It should be noted that in some examples of the antennas described herein, that the antenna holder may end at the edge of the excitation surface or may extend beyond the excitation surface. For example, an antenna holder may extend to support a monopole excitation radiator feed, a loop excitation radiator feed, and/or one or more additional excitation surfaces. In cascaded structures, for example, the antenna holder may support multiple excitation surfaces.

Different varieties of antenna arrangements may provide benefits. In some examples, a monopole-type excitation radiator feed may be implemented with a feed by the fourth side (e.g., a source located by and/or on the front side) for some WLAN antennas. In some examples, a loop-type excitation radiator feed may be implemented with a feed by the third side (e.g., a source located by and/or on the back side) for improved impedance matching bandwidth.

In the example shown in FIG. 1, the source 114 may be coupled to the excitation radiator feed 110 (e.g., metal feed strip) adjacent to (e.g., near, by, next to, etc.) the third side 118. In some examples, the source 114 (e.g., feeding signal source) may be fed from a direction adjacent to the grounding surface 112. In other examples, the source 114 may be coupled to the excitation radiator feed 110 adjacent to a fourth side 160 (e.g., the front side) opposite the third side 118.

Other variations of the antenna 100 are possible. In some examples, the antenna 100 may include an extension arm of the excitation surface 104 that extends onto the fourth side 160 (e.g., the front side). The extension arm may be coupled to and/or part of the excitation surface 104. Additionally or alternatively, the excitation surface may include one or more slots. For example, variations of the antenna 100 may include hybrid antennas with slot loading and/or monopole loading. Variations are described in greater detail below.

In some examples, the antenna 100 may include one or more additional antenna holders, one or more additional excitation surfaces, etc. For example, a second parallelepipedal antenna holder with a second excitation surface may be arranged in a cascading structure relative to the excitation surface 104.

As can be observed, the excitation radiator feed 110 may provide greater feed size and/or length in comparison with a direct feed, which may be limited by antenna height. For instance, in some approaches, a direct feed may be vertically inserted between a metal plane and an excitation surface, thereby limiting the length of the feed size by antenna height. Accordingly, the excitation radiator feed 110 may provide enhanced antenna 100 radiation.

Figure 2:
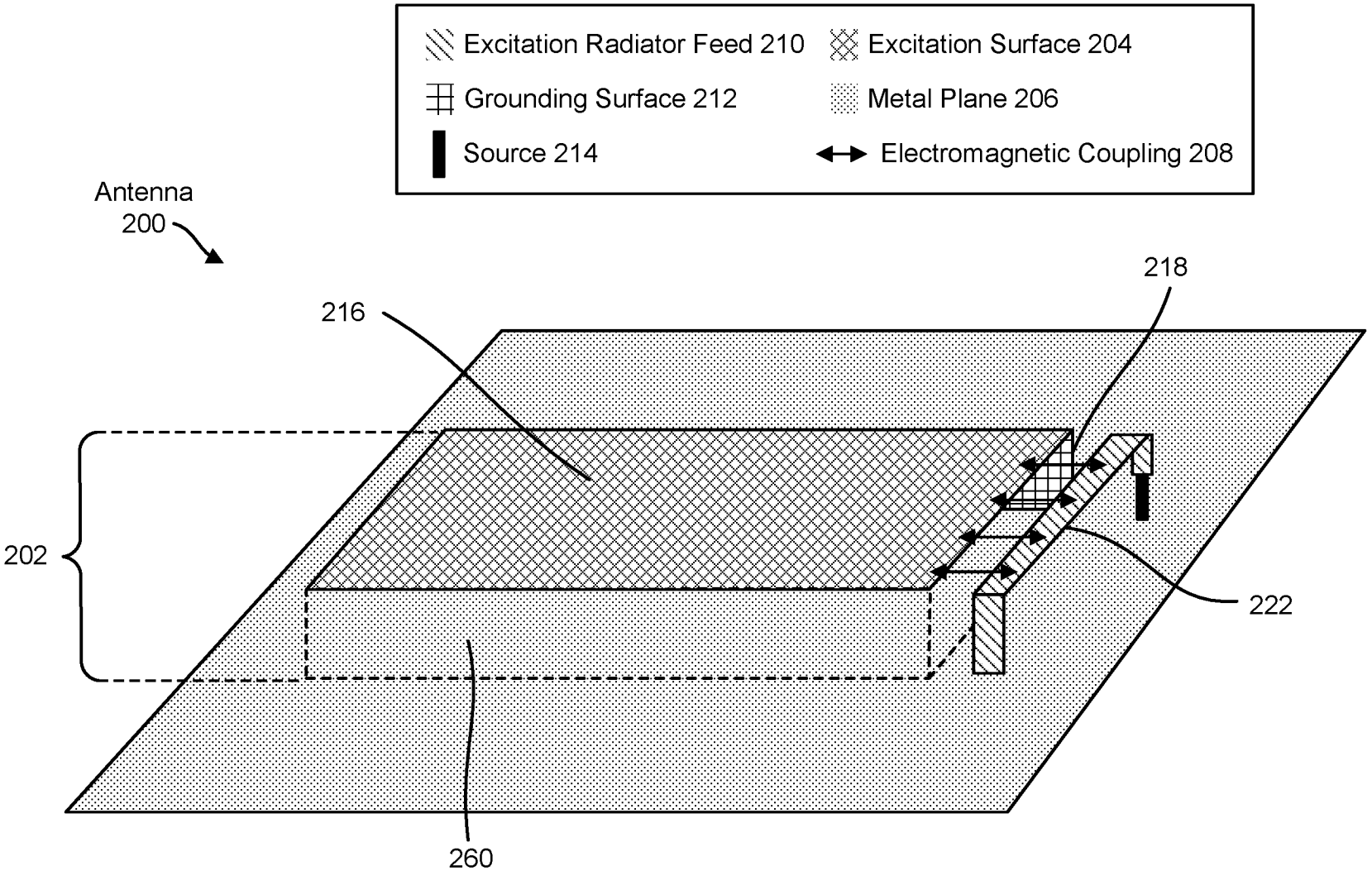
FIG. 2 illustrates a perspective view of an example of an antenna with a loop excitation radiator feed.

FIG. 2 illustrates a perspective view of an example of an antenna 200 with a loop excitation radiator feed. The antenna 200 may be another example of a patch antenna. The antenna 200 includes some elements as similarly described in FIG. 1. For example, the antenna 200 includes a parallelepipedal antenna holder 202, an excitation surface 204 (e.g., metal patch) situated on a first side 216 of the antenna holder 202, a second side of the antenna holder 202 that may be situated on a metal plane 206, and a grounding surface 212 (e.g., a metal wall) situated on a third side 218 as described in FIG. 1.

The antenna 200 may include an excitation radiator feed 210 (e.g., a metal feed strip) situated to provide electromagnetic coupling 208 between the excitation radiator feed 210 and the excitation surface 204. The excitation radiator feed 210 may be situated next to the excitation surface 204, and/or may not be in direct contact with the excitation surface 204. In the example shown in FIG. 2, the excitation radiator feed may be a loop 222. The loop 222 may be a metal strip. In the example shown in FIG. 2, a first end of the loop 222 (e.g., metal feed strip) may be coupled to a source 214 (e.g., a feeding signal source). A portion of the loop 222 may be approximately coplanar with the excitation surface 204. In some examples, the second end of the loop 222 may extend to the metal plane 206. For example, a portion of the loop 222 may be approximately coplanar with the excitation surface 204 (e.g., on the antenna holder 202) and a portion of the loop 222 may be approximately coplanar with the fourth side 260 (e.g., the front side) of the antenna holder 202.

In the example shown in FIG. 2, the source 214 may be coupled to the excitation radiator feed 210 (e.g., metal feed strip) adjacent to the third side 218. In some examples, the source 214 (e.g., feeding signal source) may be fed from a direction adjacent to the grounding surface 212. In other examples, the source 214 may be coupled to the excitation radiator feed 210 adjacent to a fourth side 260 (e.g., the front side) opposite the third side 218.

Other variations of the antenna 200 are possible, such as one or more extension arms, one or more slots, one or more additional antenna holders, etc., as described in FIG. 1. The excitation radiator feed 110 may provide enhanced antenna 200 radiation in comparison with a direct feed, due to greater feed size and/or length.

Figure 3:
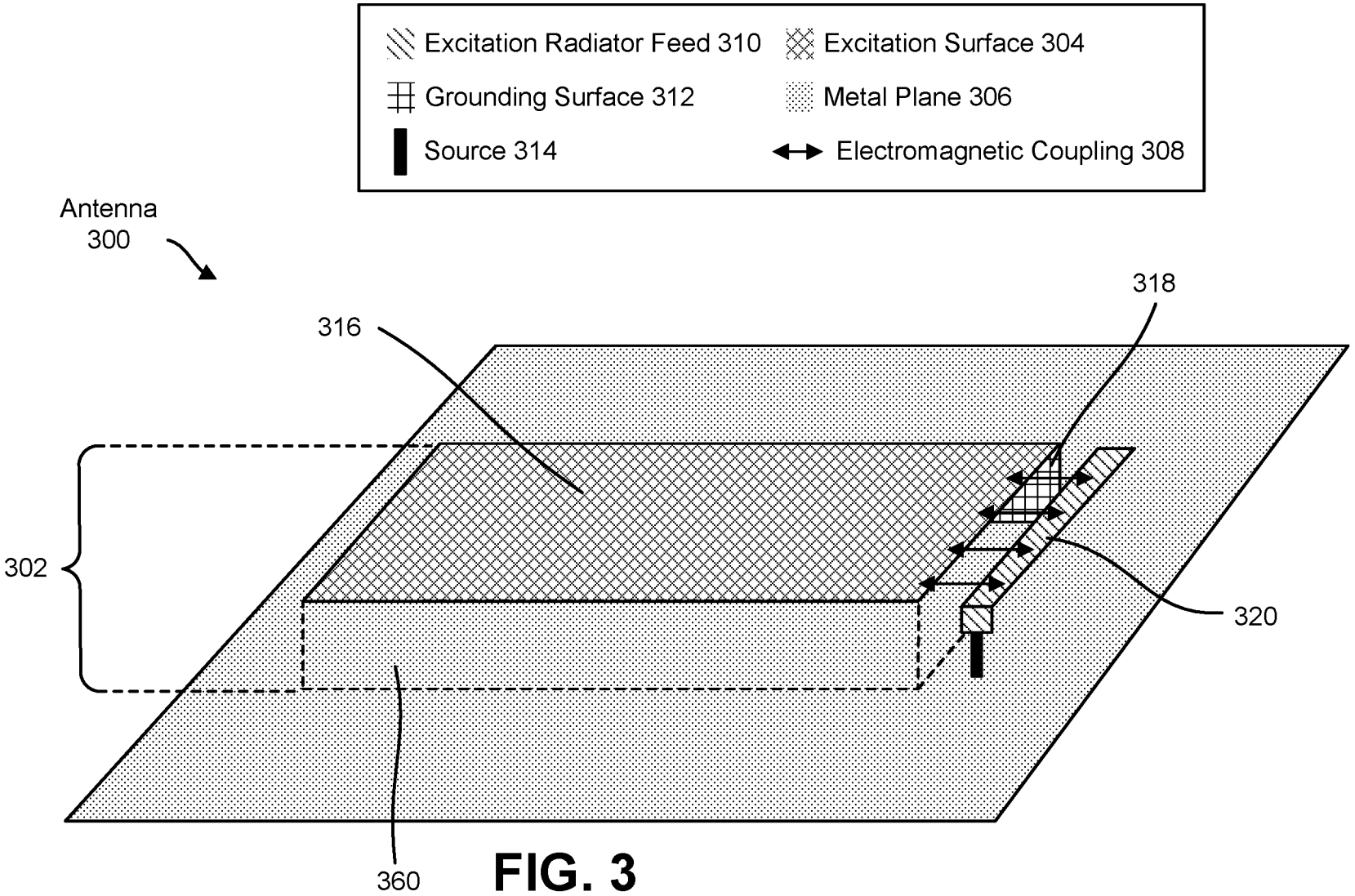
FIG. 3 illustrates a perspective view of an example of an antenna with a monopole excitation radiator feed by the front side of the antenna.

FIG. 3 illustrates a perspective view of an example of an antenna 300 with a monopole excitation radiator feed by the front side of the antenna 300. The antenna 300 may be another example of a patch antenna. The antenna 300 includes some elements as similarly described in FIG. 1. For example, the antenna 300 includes a parallelepipedal antenna holder 302, an excitation surface 304 (e.g., metal patch) situated on a first side 316 of the antenna holder 302, a second side of the antenna holder 302 that may be situated on a metal plane 306, and a grounding surface 312 (e.g., a metal wall) situated on a third side 318 as described in FIG. 1.

The antenna 300 may include an excitation radiator feed 310 (e.g., a metal feed strip) situated to provide electromagnetic coupling 308 between the excitation radiator feed 310 and the excitation surface 304. The excitation radiator feed 310 may be situated next to the excitation surface 304, and/or may not be in direct contact with the excitation surface 304. In the example shown in FIG. 3, the excitation radiator feed may be a monopole 320. In the example shown in FIG. 3, a first end of the monopole 320 (e.g., metal feed strip) may be coupled to a source 314 (e.g., a feeding signal source). All or a portion of the monopole 320 may be approximately coplanar with the excitation surface 304. In some examples, the second end of the monopole 320 may only extend to any length up to a side wall (e.g., to the back, to the grounding surface 312, etc.) of the antenna holder 102 and/or may not contact the metal plane 306.

In the example shown in FIG. 3, the source 314 may be coupled to the excitation radiator feed 310 (the monopole 320) adjacent to the fourth side 360 of the antenna holder 302 (opposite from the third side 318 or grounding surface 312). In some examples, the source 314 (e.g., feeding signal source) may be fed from a direction opposite to the grounding surface 312.

Other variations of the antenna 300 are possible, such as one or more extension arms, one or more slots, one or more additional antenna holders, etc., as described in FIG. 1. The excitation radiator feed 110 may provide enhanced antenna 300 radiation in comparison with a direct feed, due to greater feed size and/or length.

Figure 4:
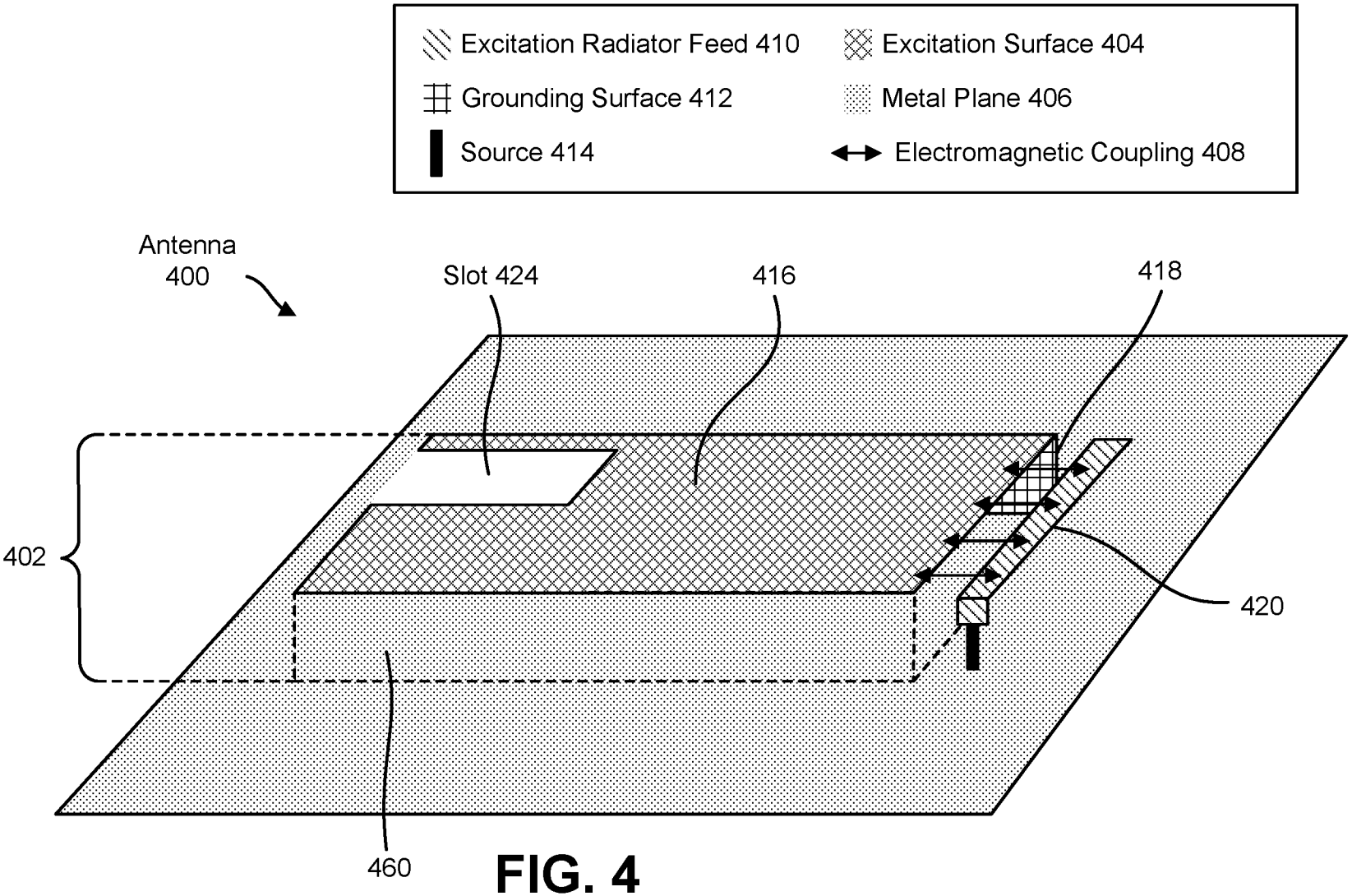
FIG. 4 illustrates a perspective view of an example of an antenna with a slot.

FIG. 4 illustrates a perspective view of an example of an antenna 400 with a slot 424. The antenna 400 may be another example of a patch antenna. The antenna 400 includes some elements as similarly described in FIG. 1. For example, the antenna 400 includes a parallelepipedal antenna holder 402, an excitation surface 404 (e.g., metal patch) situated on a first side 416 of the antenna holder 402, a second side of the antenna holder 402 that may be situated on a metal plane 406, and a grounding surface 412 (e.g., a metal wall) situated on a third side 418 as described in FIG. 1.

The antenna 400 may include a monopole 420 excitation radiator feed 410 (e.g., a metal feed strip) situated to provide electromagnetic coupling 408 between the excitation radiator feed 410 and the excitation surface 404, as similarly described in FIG. 3. The source 414 may be coupled to the excitation radiator feed 410 (the monopole 420) adjacent to the fourth side 460 of the antenna holder 402 (opposite from the third side 418 or grounding surface 412).

In the example illustrated in FIG. 4, the antenna 400 includes a slot 424 in the excitation surface 404 on the first side 416. The slot 424 may be situated along an edge that may be opposite from the excitation radiator feed 410. In some examples, the slot 424 may be open-circuited at one of the slot ends and short-circuited at one of the slot ends (e.g., an "O.C.-S.C." slot). The slot 424 (e.g., slot perturbation) may lower patch resonance frequency. Other variations of the antenna 400 are possible, such as one or more extension arms, one or more additional antenna holders, etc., as described in FIG. 1.

Figure 5:
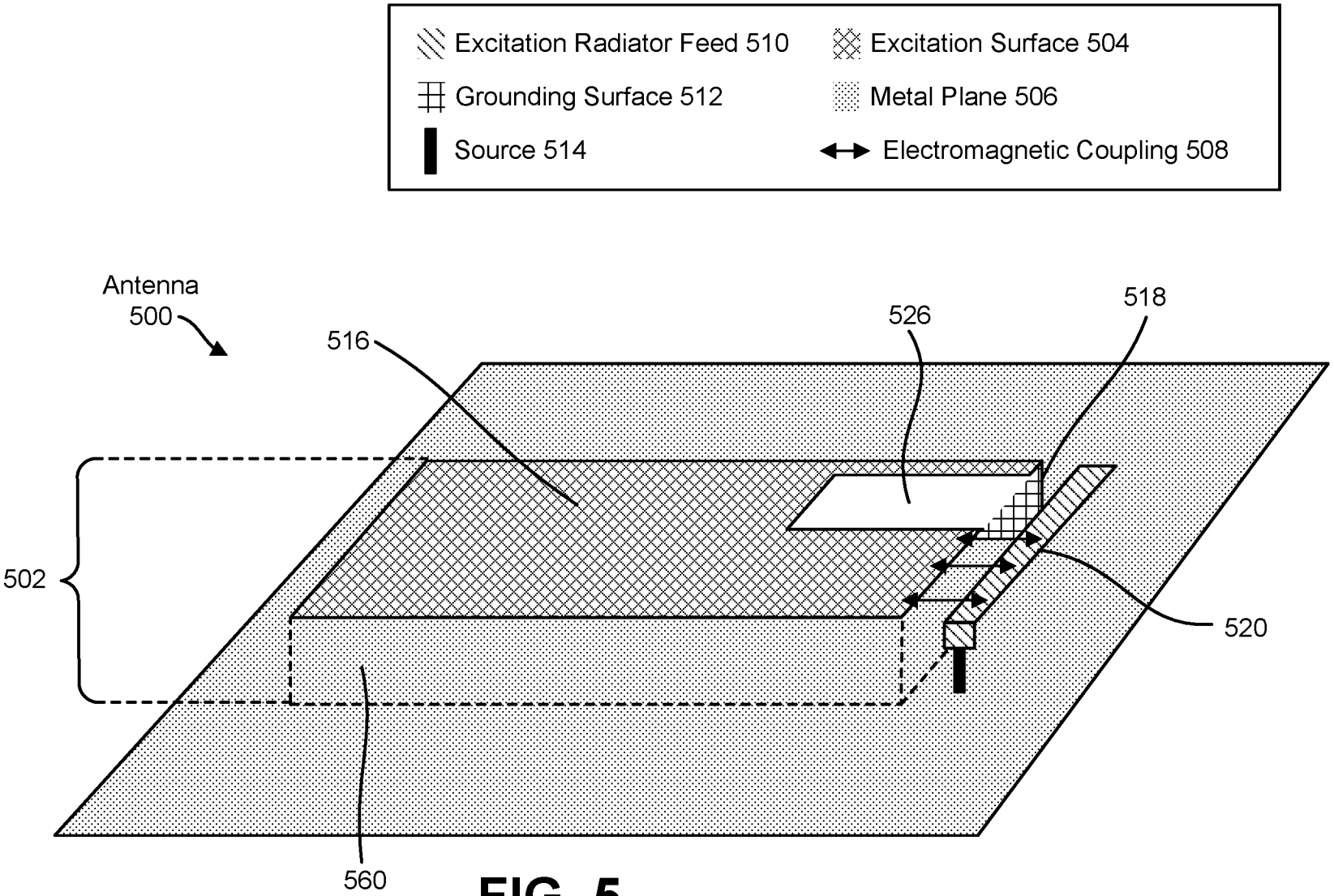
FIG. 5 illustrates a perspective view of an example of an antenna with a slot next to an excitation radiator feed.

FIG. 5 illustrates a perspective view of an example of an antenna 500 with a slot 526 next to an excitation radiator feed 510. The antenna 500 may be another example of a patch antenna. The antenna 500 includes some elements as similarly described in FIG. 1. For example, the antenna 500 includes a parallelepipedal antenna holder 502, an excitation surface 504 (e.g., metal patch) situated on a first side 516 of the antenna holder 502, a second side of the antenna holder 502 that may be situated on a metal plane 506, and a grounding surface 512 (e.g., a metal wall) situated on a third side 518 as described in FIG. 1.

The antenna 500 may include a monopole 520 excitation radiator feed 510 (e.g., a metal feed strip) situated to provide electromagnetic coupling 508 between the excitation radiator feed 510 and the excitation surface 504, as similarly described in FIG. 3. The source 514 may be coupled to the excitation radiator feed 510 (the monopole 520) adjacent to the fourth side 560 of the antenna holder 502 (opposite from the third side 518 or grounding surface 512).

In the example illustrated in FIG. 5, the antenna 500 includes a slot 526 in the excitation surface 504 on the first side 516. The slot 526 may be situated along an edge that may be next to the excitation radiator feed 510. The slot 526 (e.g., slot perturbation) may lower patch resonance frequency. In some examples, the slot 526 may be an O.C.-S.C. slot. Other variations of the antenna 500 are possible, such as one or more extension arms, one or more additional antenna holders, etc., as described in FIG. 1.

Figure 6:
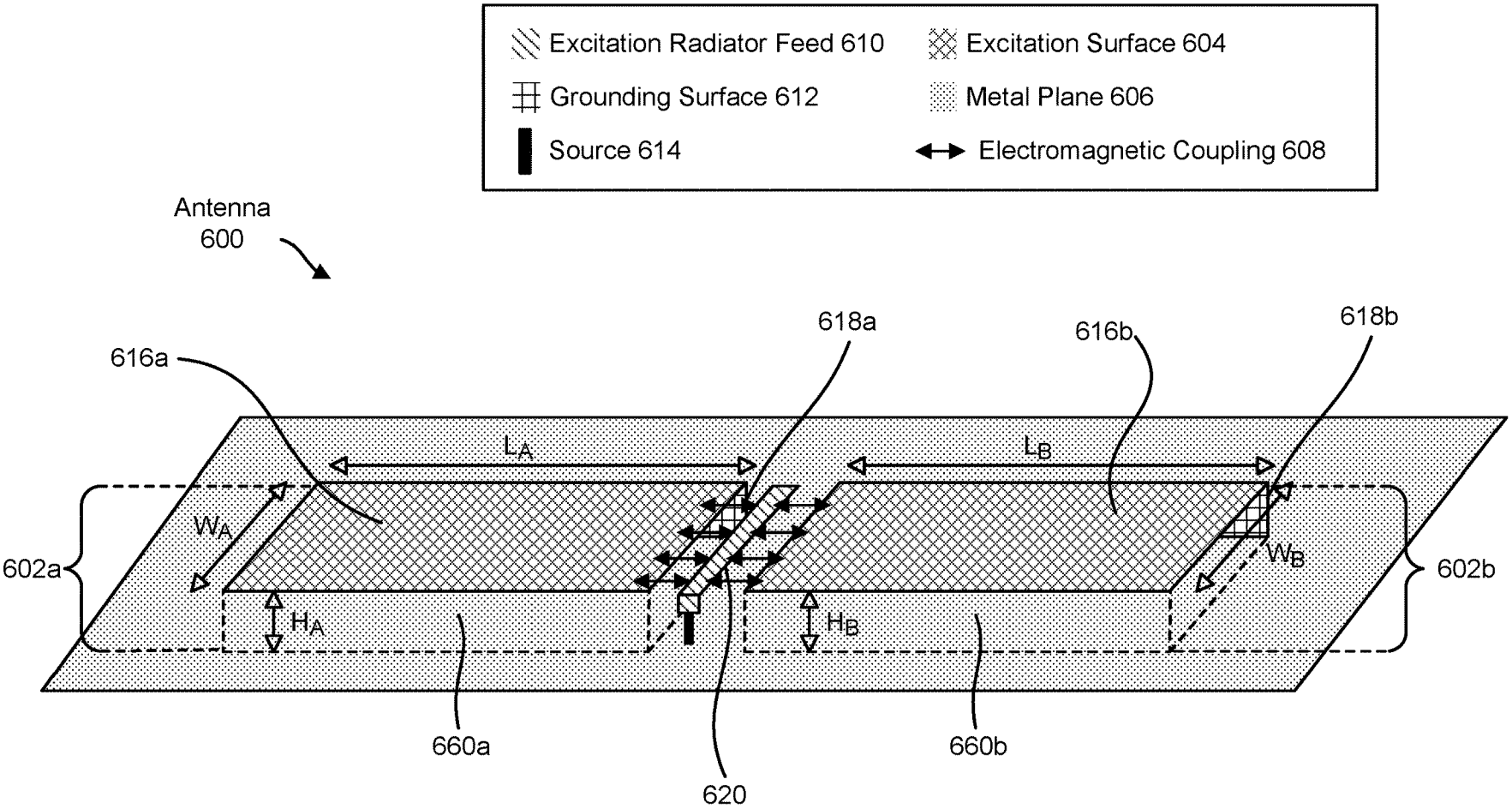
FIG. 6 illustrates a perspective view of an example of an antenna arranged in a cascading structure.

FIG. 6 illustrates a perspective view of an example of an antenna 600 arranged in a cascading structure. The antenna 600 may be another example of a patch antenna. The antenna 600 includes some elements as similarly described in FIG. 1. For example, the antenna 600 includes parallelepipedal antenna holders 602*a-b*, excitation surfaces 604 (e.g., metal patches) situated on first sides 616*a-b* of the antenna holders 602*a-b*, second sides of the antenna holders 602*a-b* that may be situated on a metal plane 606, and grounding surfaces 612 (e.g., metal walls) situated on third sides 618*a-b* as described in FIG. 1.

The antenna 600 may include a monopole 620 excitation radiator feed 610 (e.g., a metal feed strip) situated to provide electromagnetic coupling 608 between the excitation radiator feed 610 and the excitation surfaces 604, as similarly described in FIG. 3. The source 614 may be coupled to the excitation radiator feed 610 (the monopole 620) adjacent to the fourth sides 660*a-b* of the antenna holders 602*a-b* (opposite from the third sides 618*a-b* or grounding surfaces 612).

In the example illustrated in FIG. 6, the antenna 600 may be arranged in a cascaded structure. The antenna 600 may be referred to as a cascaded coupled feed shorted patch antenna. As illustrated in FIG. 6, a first antenna holder 602*a* has dimensions $L_A \times W_A \times H_A$, and a second antenna holder 602*b* has dimensions $L_B \times W_B \times H_B$. The dimensions of the antenna holders 602*a-b* may or may not be the same. For example, $L_A$ may not necessarily be equal to $L_B$ and/or $W_A$ may not necessarily be equal to $W_B$. In this example, the grounding surfaces 612 (on the third sides 618*a-b*) may not be connected. Other variations of the antenna 600 are possible, such as one or more slots, one or more extension arms, etc., as described in FIG. 1. In some examples of cascaded structures, multiple excitation surfaces may be situated on a single antenna holder and/or the excitation radiator feed may be situated on the antenna holder.

Figure 7:
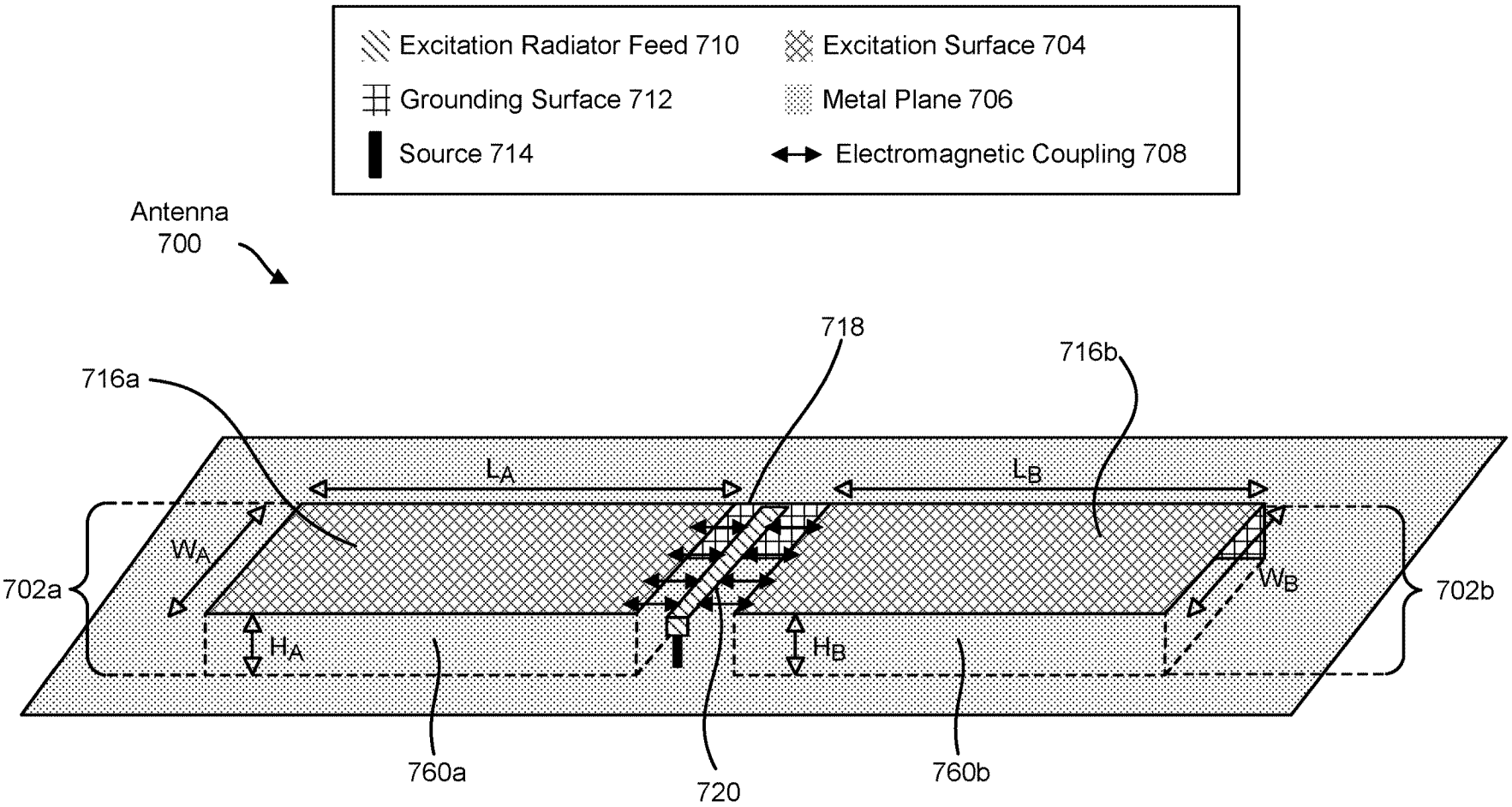
FIG. 7 illustrates a perspective view of an example of an antenna arranged in a cascading structure with connected shorting walls.

FIG. 7 illustrates a perspective view of an example of an antenna 700 arranged in a cascading structure with connected shorting walls. The antenna 700 may be another example of a patch antenna. The antenna 700 includes some elements as similarly described in FIG. 1. For example, the antenna 700 includes parallelepipedal antenna holders 702*a-b*, excitation surfaces 704 (e.g., metal patches) situated on first sides 716*a-b* of the antenna holders 702*a-b*, second sides of the antenna holders 702*a-b* that may be situated on a metal plane 706, and a grounding surface 712 (e.g., metal walls) situated on third sides 718*a-b* as described in FIG. 1. In the example shown in FIG. 7, the grounding surface 712 may be connected between antenna holders 702*a-b*. The shorting walls on the third sides 718*a-b* of the antenna holders 702*a-b* may be connected over a gap where the excitation radiator feed 710 may be situated.

The antenna 700 may include a monopole 720 excitation radiator feed 710 (e.g., a metal feed strip) situated to provide electromagnetic coupling 708 between the excitation radiator feed 710 and the excitation surfaces 704, as similarly described in FIG. 3. The source 714 may be coupled to the excitation radiator feed 710 (the monopole 720) adjacent to the fourth sides 760*a-b* of the antenna holders 702*a-b* (opposite from the third sides 718*a-b* or grounding surface 712). The monopole 720 may not be connected to the grounding surface 712.

In the example illustrated in FIG. 7, the antenna 700 may be arranged in a cascaded structure. The antenna 700 may be referred to as a cascaded coupled feed shorted patch antenna. As illustrated in FIG. 7, a first antenna holder 702*a* has dimensions $L_A \times W_A \times H_A$, and a second antenna holder 702*b* has dimensions $L_B \times W_B \times H_B$. The dimensions of the antenna holders 702*a-b* may or may not be the same. For example, $L_A$ may not necessarily be equal to $L_B$ and/or $W_A$ may not necessarily be equal to $W_B$. Other variations of the antenna 700 are possible, such as one or more slots, one or more extension arms, etc., as described in FIG. 1.

Figure 8:
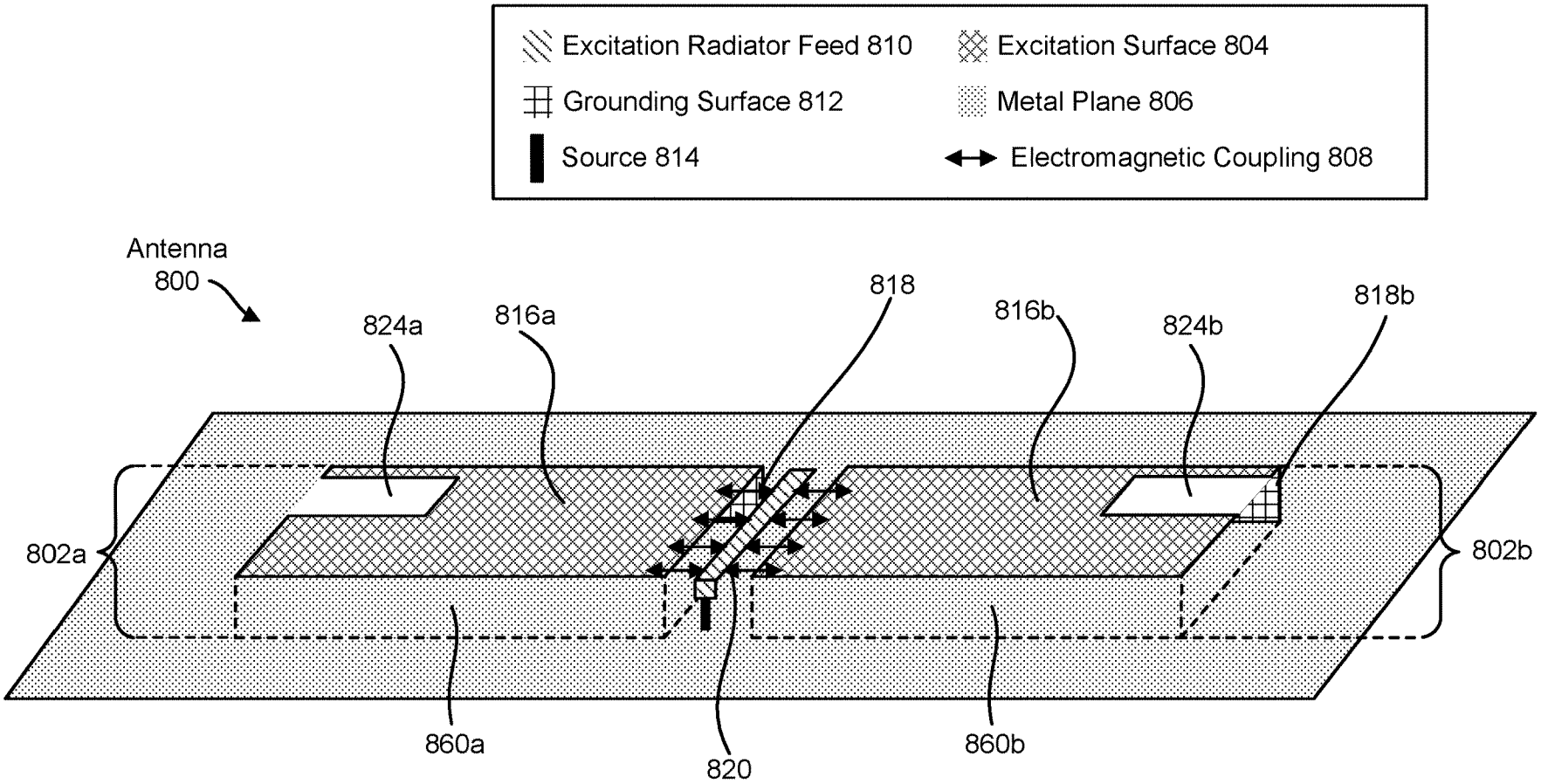
FIG. 8 illustrates a perspective view of an example of an antenna arranged in a cascading structure with outer edge slots.

FIG. 8 illustrates a perspective view of an example of an antenna 800 arranged in a cascading structure with outer edge slots 824*a-b*. The antenna 800 may be another example of a patch antenna. The antenna 800 includes some elements as similarly described in FIG. 1. For example, the antenna 800 includes parallelepipedal antenna holders 802*a-b*, excitation surfaces 804 (e.g., metal patches) situated on first sides 816*a-b* of the antenna holders 802*a-b*, second sides of the antenna holders 802*a-b* that may be situated on a metal plane 806, and grounding surfaces 812 (e.g., metal walls) situated on third sides 818*a-b* as described in FIG. 1.

The antenna 800 may include a monopole 820 excitation radiator feed 810 (e.g., a metal feed strip) situated to provide electromagnetic coupling 808 between the excitation radiator feed 810 and the excitation surfaces 804, as similarly described in FIG. 3. The source 814 may be coupled to the excitation radiator feed 810 (the monopole 820) adjacent to the fourth sides 860*a-b* of the antenna holders 802*a-b* (opposite from the third sides 818*a-b* or grounding surface 812).

In the example illustrated in FIG. 8, the antenna 800 may be arranged in a cascaded structure. The antenna 800 may be referred to as a cascaded coupled feed shorted patch antenna with O.C.-S.C. slots. Additionally, the antenna 800 includes slots 824*a-b* in the excitation surfaces 804 on the first sides 816*a-b*. The slots 824*a-b* may be situated along edges that may be opposite from the excitation radiator feed 810. Other variations of the antenna 800 are possible, such as one or more extension arms, etc., as described in FIG. 1.

Figure 9:
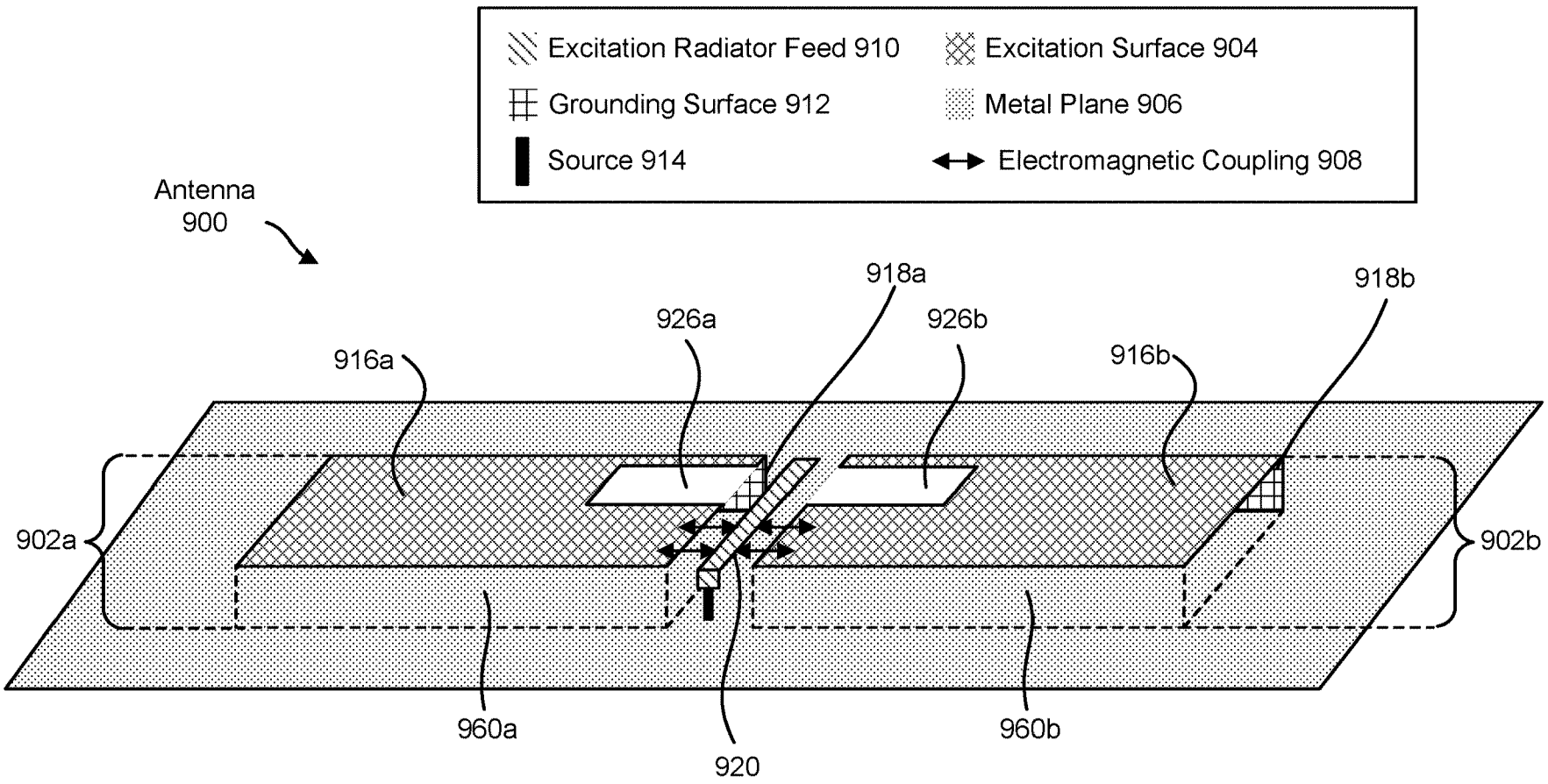
FIG. 9 illustrates a perspective view of an example of an antenna arranged in a cascading structure with inner edge slots.

FIG. 9 illustrates a perspective view of an example of an antenna 900 arranged in a cascading structure with inner edge slots 926*a-b*. The antenna 900 may be another example of a patch antenna. The antenna 900 includes some elements as similarly described in FIG. 1. For example, the antenna 900 includes parallelepipedal antenna holders 902*a-b*, excitation surfaces 904 (e.g., metal patches) situated on first sides 916*a-b* of the antenna holders 902*a-b*, second sides of the antenna holders 902*a-b* that may be situated on a metal plane 906, and grounding surfaces 912 (e.g., metal walls) situated on third sides 918*a-b* as described in FIG. 1.

The antenna 900 may include a monopole 920 excitation radiator feed 910 (e.g., a metal feed strip) situated to provide electromagnetic coupling 908 between the excitation radiator feed 910 and the excitation surfaces 904, as similarly described in FIG. 3. The source 914 may be coupled to the excitation radiator feed 910 (the monopole 920) adjacent to the fourth sides 960*a-b* of the antenna holders 902*a-b* (opposite from the third sides 918*a-b* or grounding surface 912).

In the example illustrated in FIG. 9, the antenna 900 may be arranged in a cascaded structure. The antenna 900 may be referred to as a cascaded coupled feed shorted patch antenna with O.C.-S.C. slots. Additionally, the antenna 900 includes slots 926*a-b* in the excitation surfaces 904 on the first sides 916*a-b*. The slots 926*a-b* may be situated along edges that may be next to the excitation radiator feed 910. Other variations of the antenna 900 are possible, such as one or more extension arms, etc., as described in FIG. 1.

Figure 10:
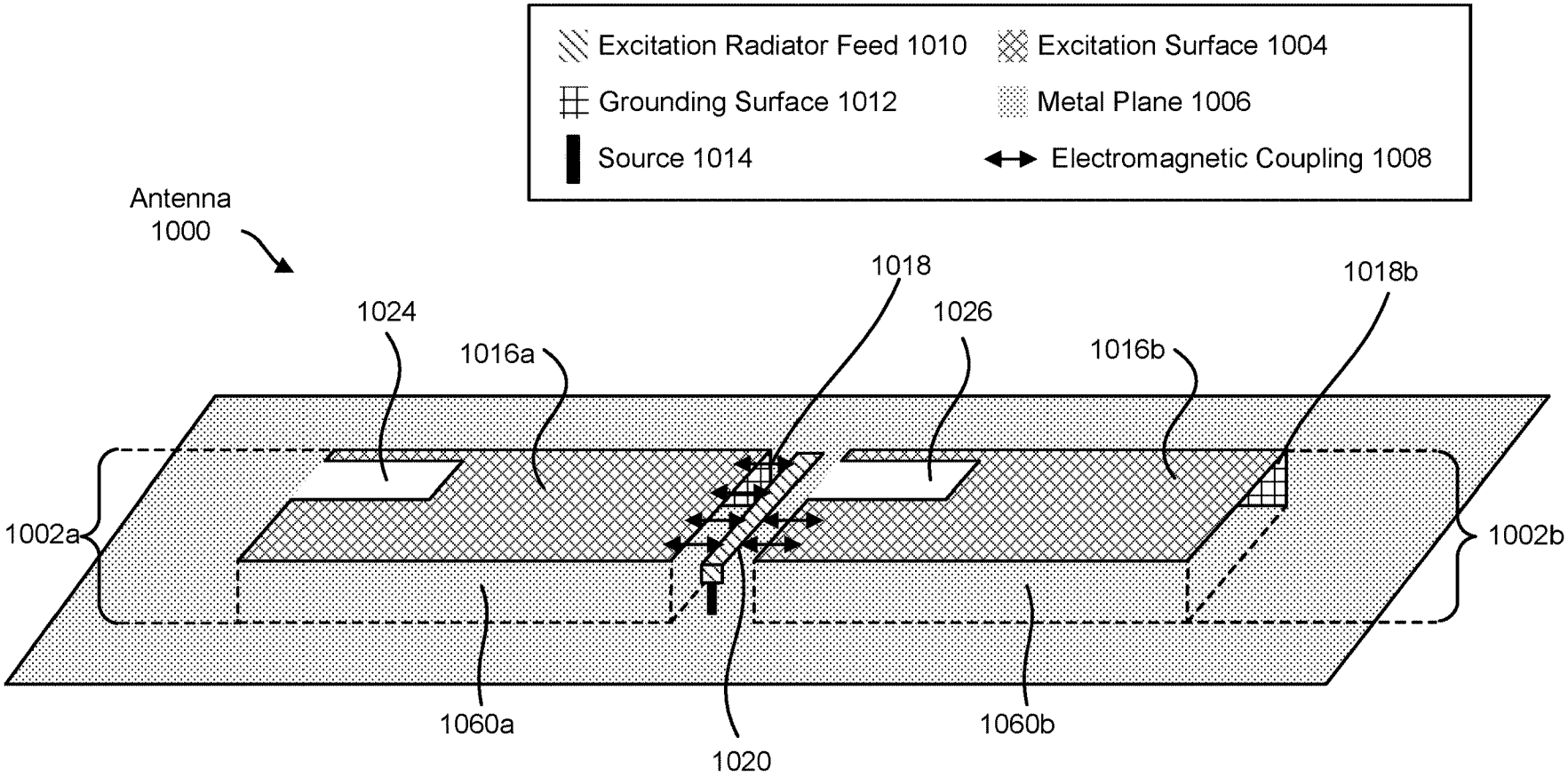
FIG. 10 illustrates a perspective view of an example of an antenna arranged in a cascading structure with an outer slot and an inner slot.

FIG. 10 illustrates a perspective view of an example of an antenna 1000 arranged in a cascading structure with an outer slot 1024 and an inner slot 1026. The antenna 1000 may be another example of a patch antenna. The antenna 1000 includes some elements as similarly described in FIG. 1. For example, the antenna 1000 includes parallelepipedal antenna holders 1002*a-b*, excitation surfaces 1004 (e.g., metal patches) situated on first sides 1016*a-b* of the antenna holders 1002*a-b*, second sides of the antenna holders 1002*a-b* that may be situated on a metal plane 1006, and grounding surfaces 1012 (e.g., metal walls) situated on third sides 1018*a-b* as described in FIG. 1.

The antenna 1000 may include a monopole 1020 excitation radiator feed 1010 (e.g., a metal feed strip) situated to provide electromagnetic coupling 1008 between the excitation radiator feed 1010 and the excitation surfaces 1004, as similarly described in FIG. 3. The source 1014 may be coupled to the excitation radiator feed 1010 (the monopole 1020) adjacent to the fourth sides 1060*a-b* of the antenna holders 1002*a-b* (opposite from the third sides 1018*a-b* or grounding surfaces 1012).

In the example illustrated in FIG. 10, the antenna 1000 may be arranged in a cascaded structure. The antenna 1000 may be referred to as a cascaded coupled feed shorted patch antenna with O.C.-S.C. slots. Additionally, the antenna 1000 includes an outer slot 1024 and an inner slot 1026 in the excitation surfaces 1004 on the first sides 1016*a-b*. The outer slot 1024 may be situated along an edge opposite to the excitation radiator feed 1010. The inner slot 1026 may be situated along an edge that may be next to the excitation radiator feed 1010. Other variations of the antenna 1000 are possible, such as one or more extension arms, etc., as described in FIG. 1.

Figure 11:
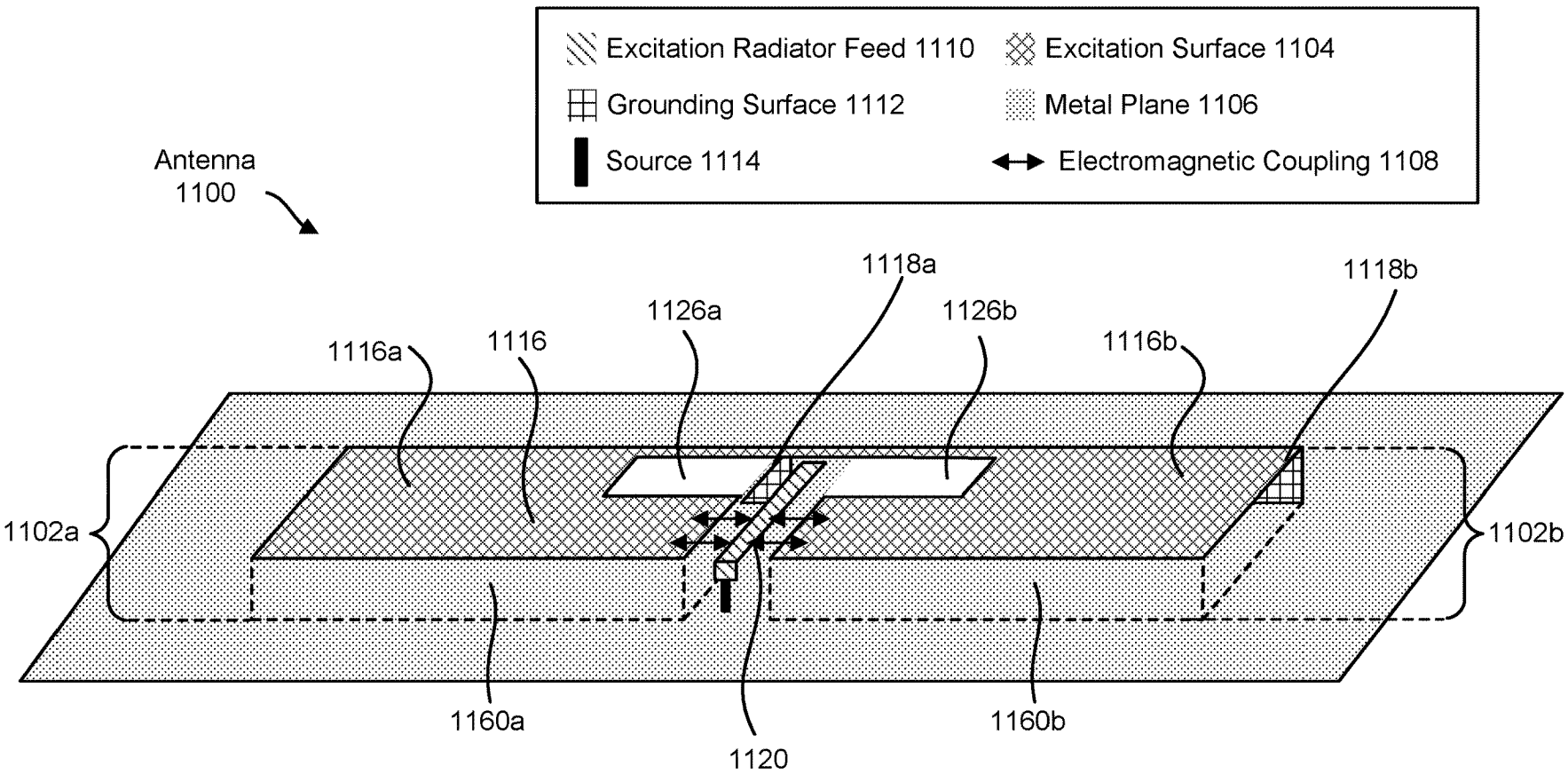
FIG. 11 illustrates a perspective view of an example of an antenna arranged in a cascading structure with inner edge slots and coupled excitation surfaces.

FIG. 11 illustrates a perspective view of an example of an antenna 1100 arranged in a cascading structure with inner edge slots 1126*a-b* and coupled excitation surfaces 1104. The antenna 1100 may be another example of a patch antenna. The antenna 1100 includes some elements as similarly described in FIG. 1. For example, the antenna 1100 includes parallelepipedal antenna holders 1102*a-b*, excitation surfaces 1104 (e.g., metal patches) situated on first sides 1116*a-b* of the antenna holders 1102*a-b*, second sides of the antenna holders 1102*a-b* that may be situated on a metal plane 1106, and grounding surfaces 1112 (e.g., metal walls) situated on third sides 1118*a-b* as described in FIG. 1.

The antenna 1100 may include a monopole 1120 excitation radiator feed 1110 (e.g., a metal feed strip) situated to provide electromagnetic coupling 1108 between the excitation radiator feed 1110 and the excitation surfaces 1104, as similarly described in FIG. 3. The source 1114 may be coupled to the excitation radiator feed 1110 (the monopole 1120) adjacent to the fourth sides 1160*a-b* of the antenna holders 1102*a-b* (opposite from the third sides 1118*a-b* or grounding surface 1112).

In the example illustrated in FIG. 11, the antenna 1100 may be arranged in a cascaded structure. The antenna 1100 may be referred to as a cascaded coupled feed shorted patch antenna with S.C.-S.C. slots. Additionally, the antenna 1100 includes slots 1126*a-b* in the excitation surfaces 1104 on the first sides 1116*a-b*. The slots 1126*a-b* may be situated along edges that may be next to the excitation radiator feed 1110.

The slots 1126*a-b* (S.C.-S.C. slots) may provide an additional half-wavelength slot-mode resonance. In this example, the excitation surfaces 1104 may be coupled (e.g., coupled across a gap where the excitation radiator feed 1110 may be situated). Other variations of the antenna 1100 are possible, such as one or more extension arms, etc., as described in FIG. 1.

Figure 12:
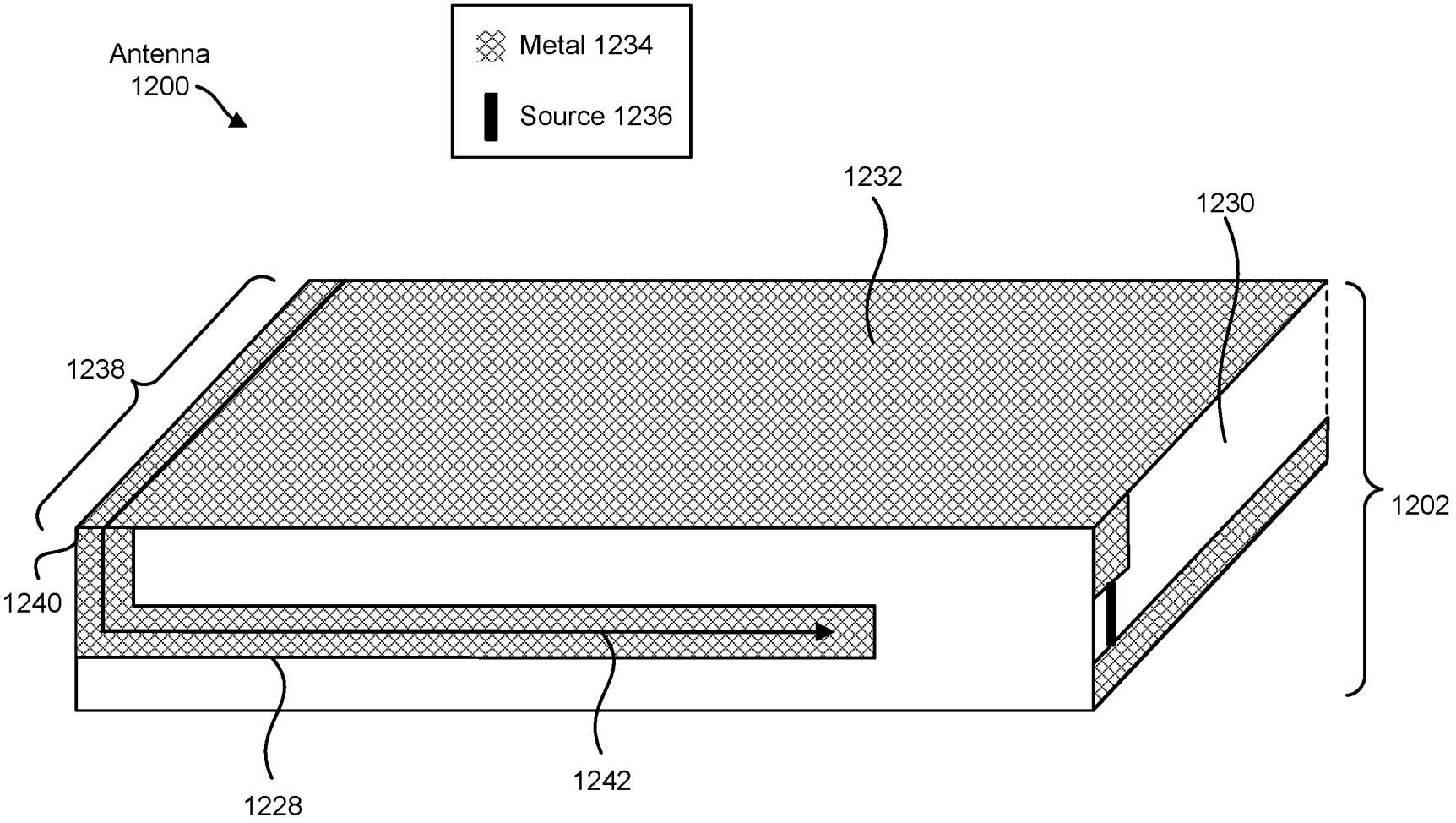
FIG. 12 illustrates a perspective view of an example of an antenna with an extension arm.

FIG. 12 illustrates a perspective view of an example of an antenna 1200 with an extension arm 1228. The antenna 1200 may be an example of a patch antenna. In some configurations, a patch antenna may have a short side dimension that may be significantly shorter than one quarter-wavelength for a lowest frequency of interest. To further reduce the compact patch antenna size and/or to support multi-band uses, one or multiple slots can be loaded to the patch structure to form a hybrid structure. Some examples of the patch or hybrid antennas described herein may provide a compact structure that may be incorporated into electronic device (e.g., display, screen, laptop, tablet, vehicle, etc.) enclosures. For instance, some of the antennas described may be placed at various locations (e.g., one or more sides) of an enclosure, may avoid extra base thickness, and/or may avoid SAR issues for clamshell and convertible devices.

The antenna 1200 includes an antenna holder 1202. As shown in FIG. 12, the antenna holder 1202 has a parallelepipedal structure. The parallelepipedal structure may include six sides, twelve edges, and eight vertices (e.g., corners at the intersection of three sides). The edges may or may not meet at right angles. A specific example of a parallelepipedal structure may be a cuboid, where each side may be rectangular and the edges meet at right angles.

The antenna holder 1202 may be implemented with a variety of materials. In an example, the antenna holder 1202 has walls formed from a plastic material, such as Polycarbonate/Acrylonitrile Butadiene Styrene (PC/ABS). The antenna holder 1202 may be hollow or may contain a di-electric material within the plastic walls. In an example, the di-electric material contained within the walls of the plastic antenna holder may have a di-electric constant higher than plastic. In an example, a ceramic material may be contained within the walls of the plastic antenna holder, where ceramic has a di-electric constant higher than plastic. In some examples (for wireless local area network (WLAN) applications, for instance), the keep-out area dimensions (the length, width, and height of the antenna space in $mm^3$) may have a length 'L' in a range of about 25 millimeters (mm) to about 35 mm, a width 'W' in a range of about 8 mm to about 12 mm, and a height 'H' in a range of about 3.0 mm to about 4.5 mm. The dimensions may be determined to meet an antenna specification. The dimensions may fit into a variety of electronic devices, such as clamshell laptops, hybrid laptop/tablet devices, tablet devices, televisions, computers, vehicles, etc.

In some examples, one or more radiating elements, such as patches, slots, and/or monopoles may be formed on one or more surfaces of the antenna holder 1202. A surface of the antenna holder 1202 bearing one or more radiating elements may be referred to an excitation surface. One or more surfaces of the antenna holder 1202 may be partly or fully coated with metal 1234 and may function either as excitation surfaces or ground surfaces. For example, the antenna holder 1202 may be a substrate (e.g., a parallelepipedal substrate, a cuboid substrate, etc.) upon which one or more metal 1234 pieces may be situated or attached.

In the example shown in FIG. 12, the antenna 1200 includes an excitation surface 1232 that may be a metal patch situated on a first side (e.g., a top side) of the antenna holder 1202. The excitation surface 1232 may partially or completely cover the first side of the antenna holder 1202. In some examples, a second side (e.g., a bottom side) of the antenna holder 1202 may be situated on a metal plane. In this example, the second side may be opposite the first side. In some examples, a grounding surface (e.g., a metal wall) may be situated on a third side between the first side and the second side (e.g., the bottom side). The grounding surface may function to ground the excitation surface (e.g., patch) 1232. The antenna 1200 may be referred to as a "shorted" patch antenna due to the grounding.

In some examples, the antenna 1200 may include a source 1236. The source 1236 may be a feeding signal source. In the example of FIG. 12, the source provides a direct feed (e.g., edge feed) to the antenna 1200. For example, the source 1236 may be coupled to the excitation surface (e.g., patch) 1232 on a fifth side (e.g., side by the source 1236 feed) of the antenna holder 1202. In other examples, an excitation radiator feed may be implemented. Other locations and/or types of feeds may be implemented.

In the example shown in FIG. 12, the antenna 1200 includes an extension arm 1228 of the excitation surface 1232 extending to a fourth side (e.g., the front side). The extension arm 1228 extends a length 1242 of an edge 1238 of the excitation surface 1232 originating from the third side (e.g., back side). In some examples, the edge 1238 may be an edge opposite from the source 1236 feed. The extension arm 1228 may extend (e.g., wrap) over a vertex 1240 (e.g., a corner at the intersection of three sides) of the antenna holder 1202.

The excitation surface 1232 may provide a resonance for a low band. For example, the metal excitation surface (e.g., patch) 1232 may produce a resonance of approximately one quarter wavelength for a low band and harmonics for a high band. In the example shown in FIG. 12, the antenna 1200 includes a slot 1230 on the fifth side of the antenna holder 1202. The slot 1230 may produce a resonance of approximately one quarter wavelength and corresponding harmonics for a high band.

Other variations of the antenna 1200 are possible. In some examples, the antenna 1200 may include one or more slots on one or more sides of the antenna holder 1202. In some examples, the antenna 1200 may include one or more additional antenna holders, one or more additional excitation surfaces, etc. For example, a second parallelepipedal antenna holder with a second excitation surface may be arranged in a cascading structure relative to the excitation surface 1204. Some variations are described in greater detail below. As can be observed, the extension arm 1228 may enable a quarter wavelength resonance while reducing the size of the antenna 1200 (e.g., one or more antenna dimensions).

Figure 13:
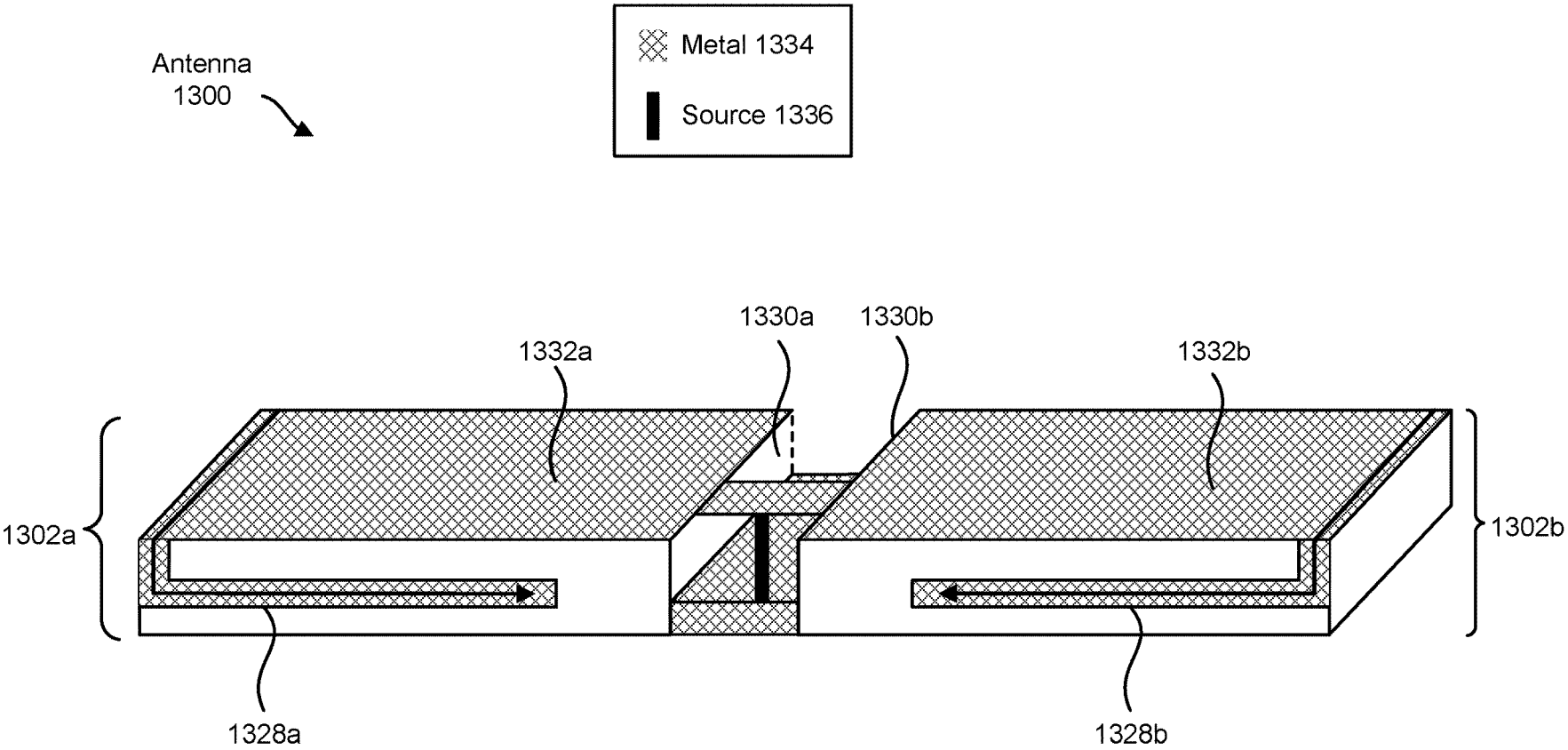
FIG. 13 illustrates a perspective view of an example of an antenna with extension arms arranged in a cascading structure.

FIG. 13 illustrates a perspective view of an example of an antenna 1300 with extension arms arranged in a cascading structure. The antenna 1300 may be another example of a patch antenna. The antenna 1300 includes some elements as similarly described in FIG. 12. For example, the antenna 1300 includes parallelepipedal antenna holders 1302*a-b*, excitation surfaces 1332*a-b* (e.g., metal patches) situated on first sides of the antenna holders 1302*a-b*, and/or grounding surfaces (e.g., metal walls) situated on third sides as described in FIG. 12. One or more sides of the antenna holders 1302*a-b* may be partially or completely covered with metal 1334.

The antenna 1300 may include a direct feed source 1336 or an excitation radiator feed. In FIG. 13, the source 1336 may be coupled to the excitation surfaces 1332*a-b*, which may be coupled together.

In FIG. 13, the antenna 1300 may be arranged in a cascaded structure. The antenna 1300 may be referred to as a compact cavity slot antenna with edge feed.

In the example shown in FIG. 13, the antenna 1300 includes extension arms 1328*a-b* of the respective excitation surfaces 1332*a-b* extending to fourth sides (e.g., the front sides) of respective antenna holders 1302*a-b*. The extension arms 1328*a-b* respectively extend the lengths of edges of the excitation surfaces 1332*a-b* originating from the third sides (e.g., back sides). In some examples, the extension arms 1328*a-b* may be implemented as described in FIG. 12.

The excitation surfaces 1332*a-b* may provide a resonance for a low band. For example, the excitation surfaces 1332 may produce a resonance of approximately one quarter wavelength for a low band and harmonics for a high band. In the example shown in FIG. 13, the antenna 1300 includes slots 1330*a-b* on the fifth sides of the antenna holders 1302. The slots 1330*a-b* may produce a resonance of approximately one quarter wavelength and corresponding harmonics for a high band. Other variations of the antenna 1300 are possible. In some examples, the antenna 1300 may include one or more slots on one or more sides of the antenna holder 1302.

Figure 14:
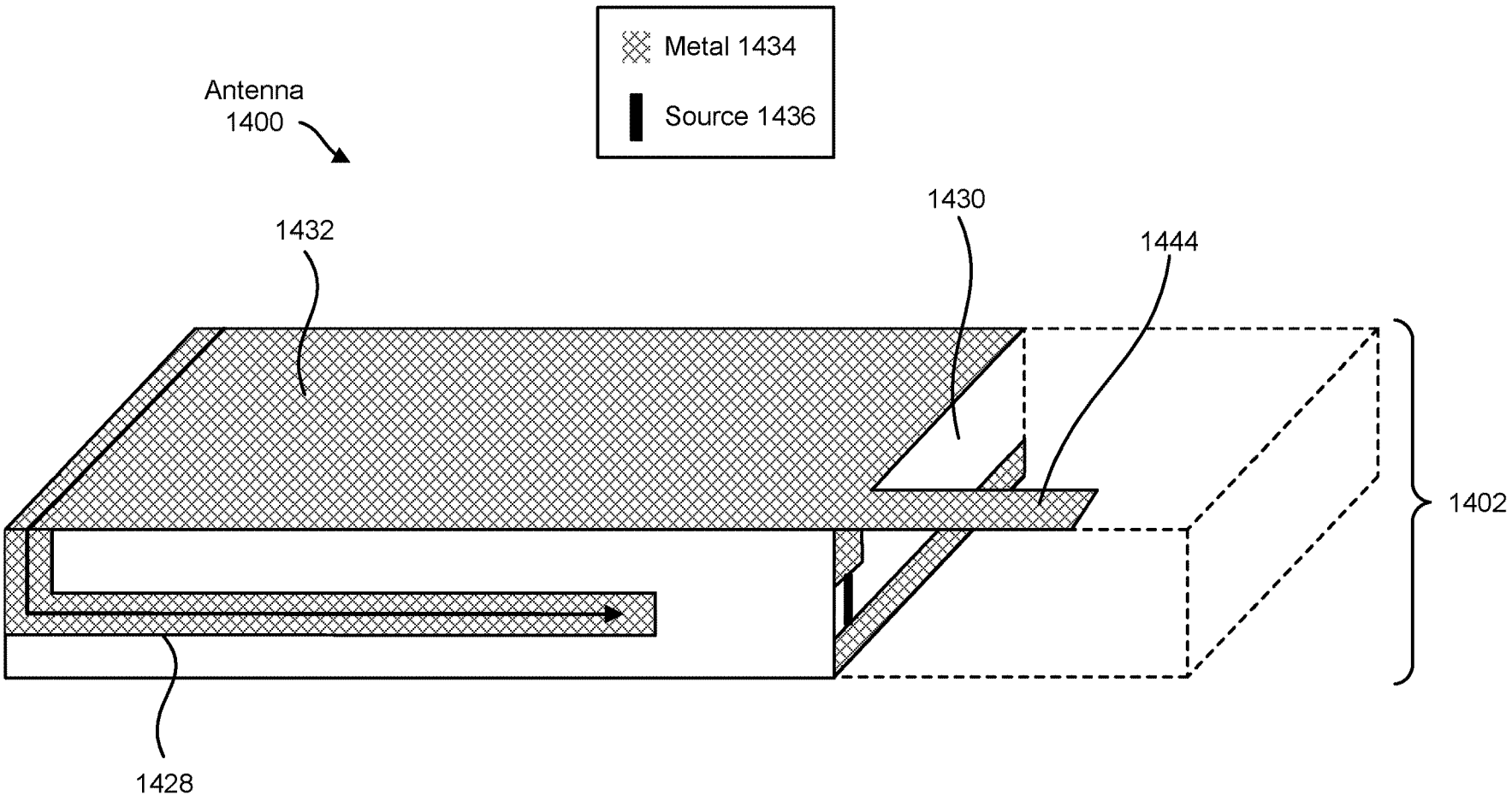
FIG. 14 illustrates a perspective view of an example of an antenna with an extension arm and a monopole.

FIG. 14 illustrates a perspective view of an example of an antenna 1400 with an extension arm 1428 and a monopole 1444. The antenna 1400 may be another example of a patch antenna. The antenna 1400 includes some elements as similarly described in FIG. 12. For example, the antenna 1400 includes a parallelepipedal antenna holder 1402, an excitation surface 1432 (e.g., metal patch) situated on the first side of the antenna holder 1402, and/or a grounding surface (e.g., metal wall) situated on the third side as described in FIG. 12. One or more sides of the antenna holder 1402 may be partially or completely covered with metal 1434.

The antenna 1400 may include a direct feed source 1436 or an excitation radiator feed. In FIG. 14, the source 1436 may be coupled to the excitation surface 1432 from the fifth side. The antenna 1400 may be referred to as a monopole-loaded compact patch antenna with edge feed.

In the example shown in FIG. 14, the antenna 1400 includes an extension arm 1428 of the excitation surface 1432 extending to the fourth side (e.g., the front side) of the antenna holder 1402. In some examples, the extension arm 1428 may be implemented as described in FIG. 12.

The excitation surface 1432 may provide a resonance for a low band. For example, the excitation surface 1432 may produce a resonance of approximately one quarter wavelength for a low band and harmonics for a high band. In the example shown in FIG. 14, the antenna 1400 includes a slot 1430 on the fifth side of the antenna holder 1402. The slot 1430 may produce a resonance of approximately one quarter wavelength and corresponding harmonics for a high band. The monopole 1444 may produce a resonance of approximately one quarter wavelength and corresponding harmonics for a second high band. Other variations of the antenna 1400 are possible. In some examples, the antenna 1400 may include one or more slots on one or more sides of the antenna holder 1402.

Figure 15:
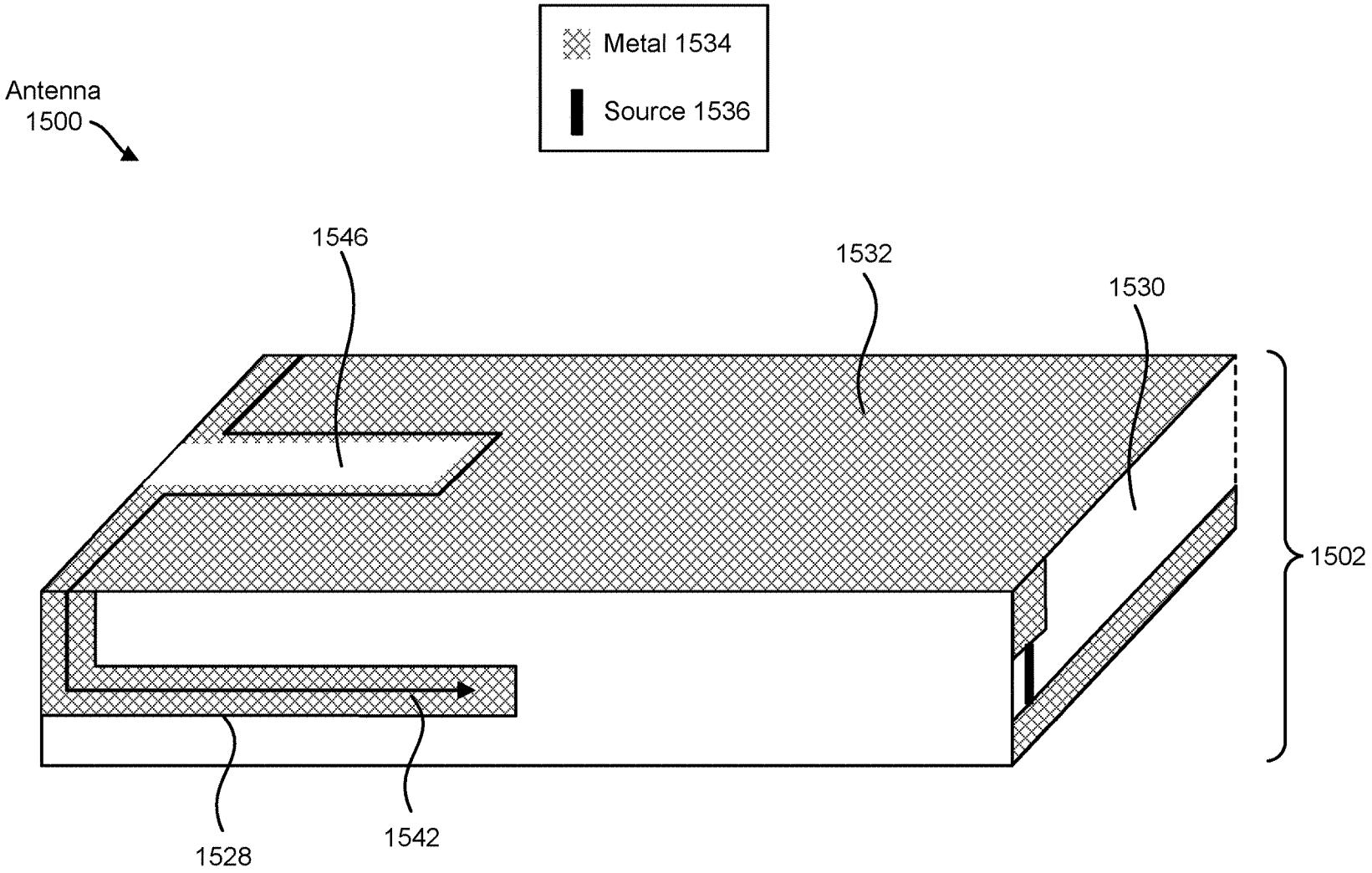
FIG. 15 illustrates a perspective view of an example of an antenna with an extension arm and two slots.

FIG. 15 illustrates a perspective view of an example of an antenna 1500 with an extension arm 1528 and two slots 1530, 1546. The antenna 1500 may be another example of a patch antenna. The antenna 1500 includes some elements as similarly described in FIG. 12. For example, the antenna 1500 includes a parallelepipedal antenna holder 1502, an excitation surface 1532 (e.g., metal patch) situated on the first side of the antenna holder 1502, and/or a grounding surface (e.g., metal wall) situated on the third side as described in FIG. 12. One or more sides of the antenna holder 1502 may be partially or completely covered with metal 1534.

The antenna 1500 may include a direct feed source 1536 or an excitation radiator feed. In FIG. 15, the source 1536 may be coupled to the excitation surface 1532 from the fifth side. The antenna 1500 may be referred to as a slot-loaded compact patch antenna with edge feed.

In the example shown in FIG. 15, the antenna 1500 includes an extension arm 1528 of the excitation surface 1532 extending to the fourth side (e.g., the front side) of the antenna holder 1502. In some examples, the extension arm 1528 may be implemented as described in FIG. 12. The slot 1546 on the first side (e.g., top side) of the antenna holder 1502 and the extension arm 1528 may extend a length 1542 of an edge of the excitation surface originating from the third side (e.g., back side).

The excitation surface 1532 may provide a resonance for a low band. For example, the excitation surface 1532 with the slot 1546 may produce a resonance of approximately one quarter wavelength for a low band and harmonics for a high band. The slot 1530 on the fifth side of the antenna holder 1502 may produce a resonance of approximately one quarter wavelength and corresponding harmonics for a high band.

Figure 16:
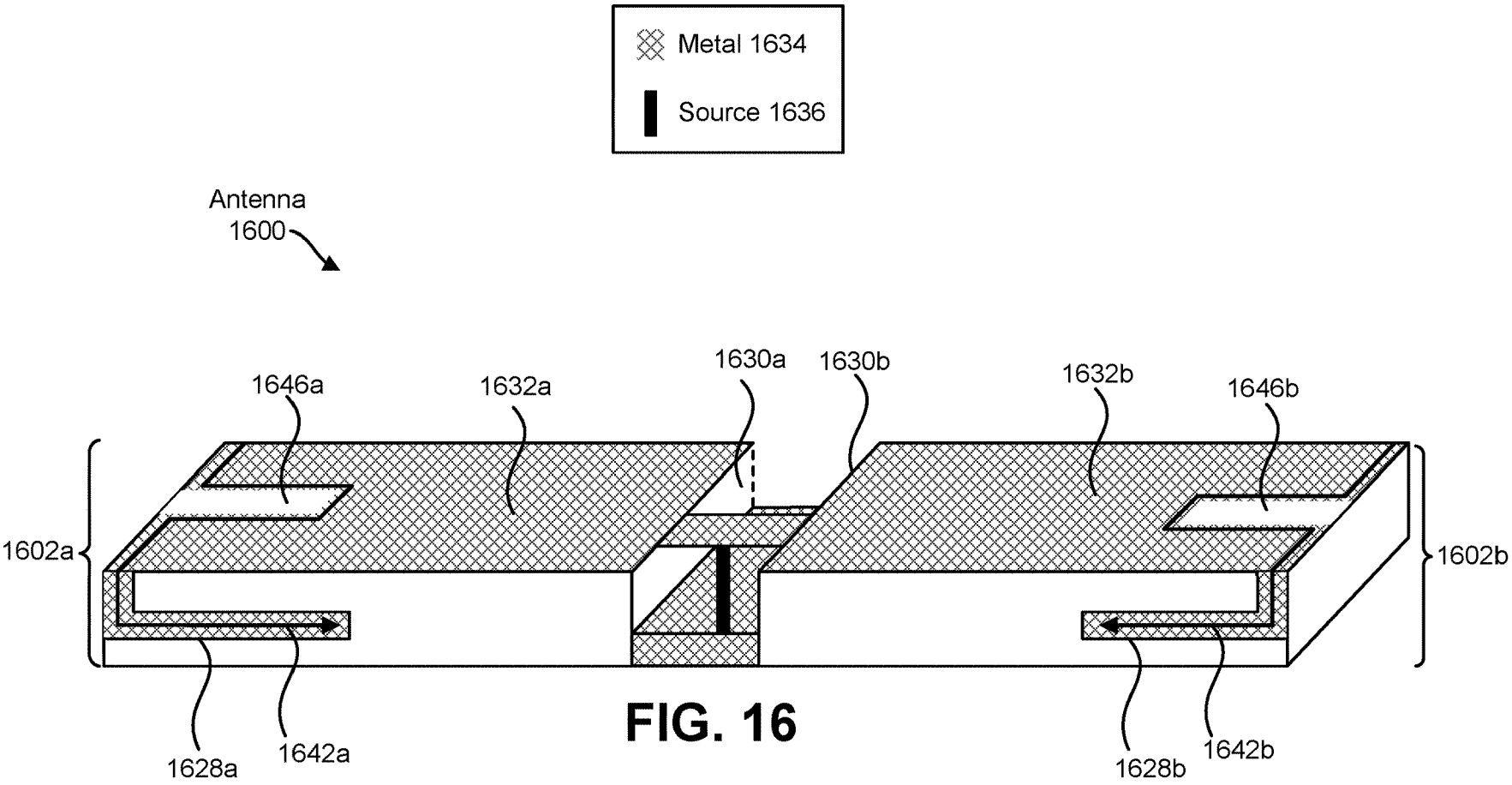
FIG. 16 illustrates a perspective view of an example of an antenna with extension arms and slots arranged in a cascading structure.

FIG. 16 illustrates a perspective view of an example of an antenna 1600 with extension arms 1628*a-b* and slots 1630*a-b*, 1646*a-b* arranged in a cascading structure. The antenna 1600 may be another example of a patch antenna. The antenna 1600 includes some elements as similarly described in FIG. 12. For example, the antenna 1600 includes parallelepipedal antenna holders 1602*a-b*, excitation surfaces 1632*a-b* (e.g., metal patches) situated on first sides of the antenna holders 1602*a-b*, and/or grounding surfaces (e.g., metal walls) situated on third sides as described in FIG. 12. One or more sides of the antenna holders 1602*a-b* may be partially or completely covered with metal 1634.

The antenna 1600 may include a direct feed source 1636 or an excitation radiator feed. In FIG. 16, the source 1636 may be coupled to the excitation surfaces 1632*a-b*, which may be coupled together.

In FIG. 16, the antenna 1600 may be arranged in a cascaded structure. The antenna 1600 may be referred to as a compact cavity slot antenna with edge feed.

In the example shown in FIG. 16, the antenna 1600 includes extension arms 1628*a-b* of the respective excitation surfaces 1632*a-b* extending to fourth sides (e.g., the front sides) of respective antenna holders 1602*a-b*. Slots 1646*a-b* may be also located on the first sides (e.g., the top sides) of the antenna holders 1602*a-b*. The extension arms 1628*a-b* and slots 1646*a-b* respectively extend the lengths 1642*a-b* of edges of the excitation surfaces 1632*a-b* originating from the third sides (e.g., back sides). In some examples, the extension arms 1628*a-b* may be implemented as described in FIG. 12.

The excitation surfaces 1632*a-b* with slot 1646*a-b* loading may provide a resonance for a low band. For example, the excitation surfaces 1632 with slots 1646*a-b* may respectively produce a resonance of approximately one quarter wavelength for a low band and harmonics for a high band. In the example shown in FIG. 16, the antenna 1600 also includes slots 1630*a-b* on the fifth sides of the antenna holders 1602. The slots 1630*a-b* may produce a resonance of approximately one quarter wavelength and corresponding harmonics for a high band. Other variations of the antenna 1600 are possible.

Figure 17:
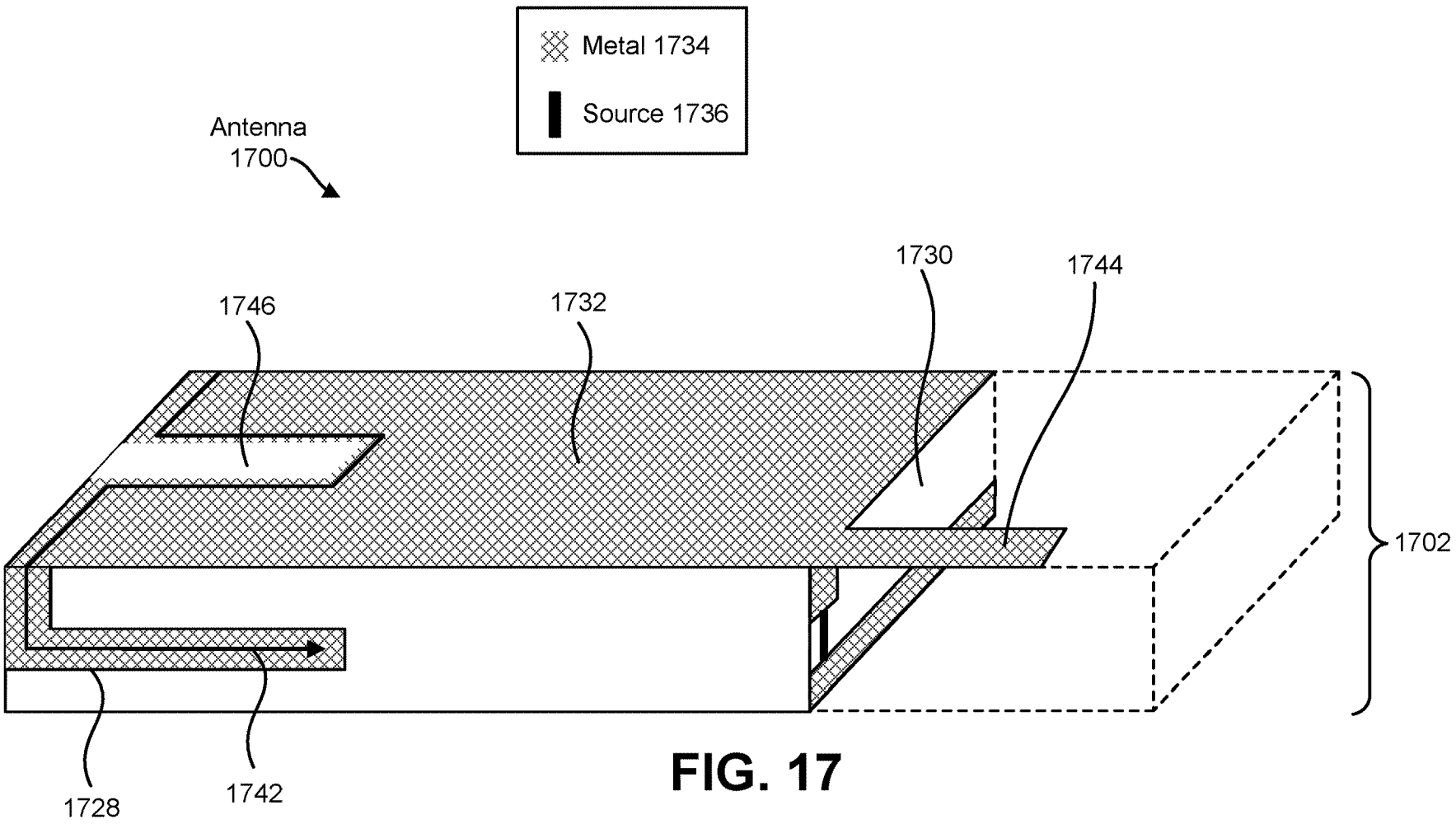
FIG. 17 illustrates a perspective view of an example of an antenna with an extension arm, a monopole, and slots.

FIG. 17 illustrates a perspective view of an example of an antenna 1700 with an extension arm 1728, a monopole 1744, and slots 1746, 1730. The antenna 1700 may be another example of a patch antenna. The antenna 1700 includes some elements as similarly described in FIG. 12. For example, the antenna 1700 includes a parallelepipedal antenna holder 1702, an excitation surface 1732 (e.g., metal patch) situated on the first side of the antenna holder 1702, and/or a grounding surface (e.g., metal wall) situated on the third side as described in FIG. 12. One or more sides of the antenna holder 1702 may be partially or completely covered with metal 1734.

The antenna 1700 may include a direct feed source 1736 or an excitation radiator feed. In FIG. 17, the source 1736 may be coupled to the excitation surface 1732 from the fifth side. The antenna 1700 may be referred to as a monopole-loaded and slot-loaded compact patch antenna with edge feed.

In the example shown in FIG. 17, the antenna 1700 includes an extension arm 1728 of the excitation surface 1732 extending to the fourth side (e.g., the front side) of the antenna holder 1702. In some examples, the extension arm 1728 may be implemented as described in FIG. 12. The slot 1746 on the first side (e.g., top side) of the antenna holder 1502 and the extension arm 1728 may extend a length 1742 of an edge of the excitation surface originating from the third side (e.g., back side).

The excitation surface 1732 may provide a resonance for a low band. For example, the excitation surface 1732 with the slot 1746 may produce a resonance of approximately one quarter wavelength for a low band and harmonics for a high band. In the example shown in FIG. 17, the antenna 1700 also includes a slot 1730 on the fifth side of the antenna holder 1702. The slot 1730 may produce a resonance of approximately one quarter wavelength and corresponding harmonics for a high band. The monopole 1744 may produce a resonance of approximately one quarter wavelength and corresponding harmonics for a second high band. Other variations of the antenna 1700 are possible.

Figure 18:
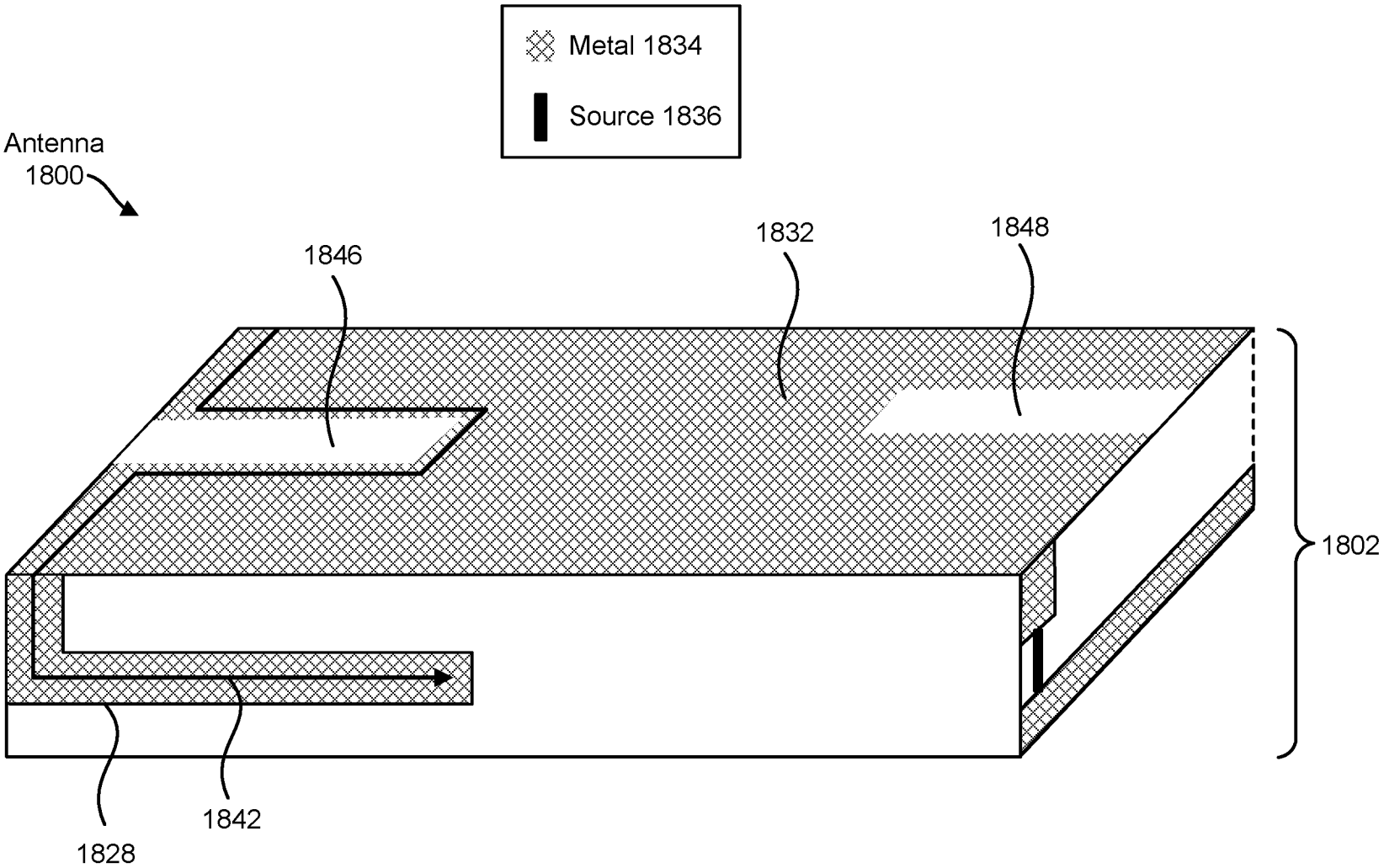
FIG. 18 illustrates a perspective view of an example of an antenna with an extension arm and two slots on the first side.

FIG. 18 illustrates a perspective view of an example of an antenna 1800 with an extension arm 1828 and two slots 1848, 1846 on the first side. The antenna 1800 may be another example of a patch antenna. The antenna 1800 includes some elements as similarly described in FIG. 12. For example, the antenna 1800 includes a parallelepipedal antenna holder 1802, an excitation surface 1832 (e.g., metal patch) situated on the first side of the antenna holder 1802, and/or a grounding surface (e.g., metal wall) situated on the third side as described in FIG. 12. One or more sides of the antenna holder 1802 may be partially or completely covered with metal 1834.

The antenna 1800 may include a direct feed source 1836 or an excitation radiator feed. In FIG. 18, the source 1836 may be coupled to the excitation surface 1832 from the fifth side. The antenna 1800 may be referred to as a compact slot-loaded compact patch antenna with edge feed.

In the example shown in FIG. 18, the antenna 1800 includes an extension arm 1828 of the excitation surface 1832 extending to the fourth side (e.g., the front side) of the antenna holder 1802. In some examples, the extension arm 1828 may be implemented as described in FIG. 12. A first slot 1846 on the first side (e.g., top side) of the antenna holder 1802 and the extension arm 1828 may extend a length 1842 of an edge of the excitation surface originating from the third side (e.g., back side).

The excitation surface 1832 may provide a resonance for a low band. For example, the excitation surface 1832 with the first slot 1846 may produce a resonance of approximately one quarter wavelength for a low band and harmonics for a high band. A second slot 1848 on the first side of the antenna holder 1802 may produce a resonance of approximately one quarter wavelength and corresponding harmonics for a high band.

Figure 19:
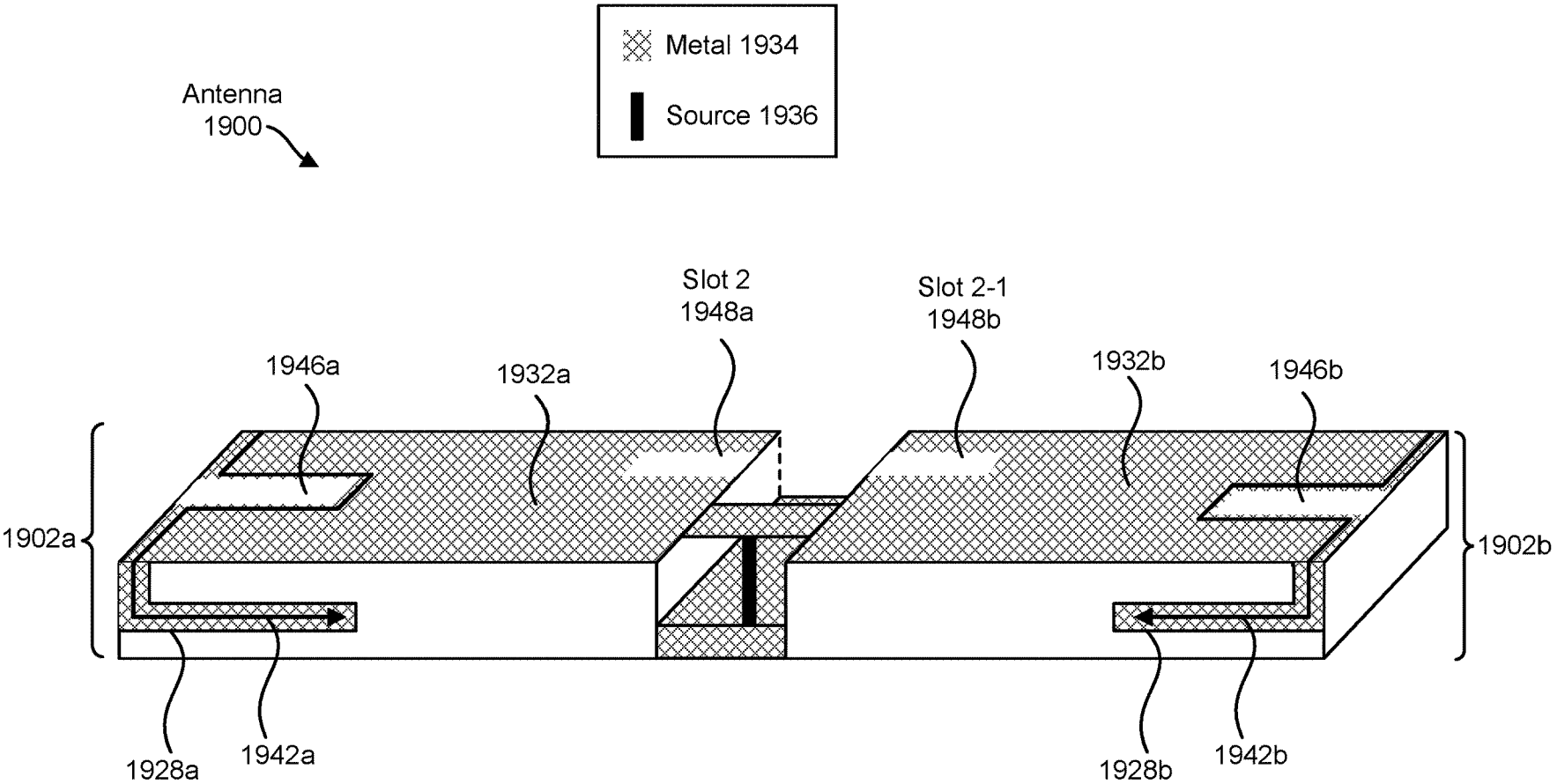
FIG. 19 illustrates a perspective view of an example of an antenna with extension arms and slots on first sides of antenna holders arranged in a cascading structure.

FIG. 19 illustrates a perspective view of an example of an antenna 1900 with extension arms 1928*a-b* and slots 1948*a-b*, 1946*a-b* on first sides of antenna holders 1902*a-b* arranged in a cascading structure. The antenna 1900 may be another example of a patch antenna. The antenna 1900 includes some elements as similarly described in FIG. 12. For example, the antenna 1900 includes parallelepipedal antenna holders 1902*a-b*, excitation surfaces 1932*a-b* (e.g., metal patches) situated on first sides of the antenna holders 1902*a-b*, and/or grounding surfaces (e.g., metal walls) situated on third sides as described in FIG. 12. One or more sides of the antenna holders 1902*a-b* may be partially or completely covered with metal 1934.

The antenna 1900 may include a direct feed source 1936 or an excitation radiator feed. In FIG. 19, the source 1936 may be coupled to the excitation surfaces 1932*a-b*, which may be coupled together.

In FIG. 19, the antenna 1900 may be arranged in a cascaded structure. The antenna 1900 may be referred to as a compact cavity slot antenna with edge feed.

In the example shown in FIG. 19, the antenna 1900 includes extension arms 1928*a-b* of the respective excitation surfaces 1932*a-b* extending to fourth sides (e.g., the front sides) of respective antenna holders 1902*a-b*. First slots 1946*a-b* may be also located on the first sides (e.g., the top sides) of the antenna holders 1902*a-b*. The extension arms 1928*a-b* and first slots 1946*a-b* respectively extend the lengths 1942*a-b* of edges of the excitation surfaces 1932*a-b* originating from the third sides (e.g., back sides). In some examples, the extension arms 1928*a-b* may be implemented as described in FIG. 12.

The excitation surfaces 1932*a-b* with first slot 1946*a-b* loading may provide a resonance for a low band. For example, the excitation surfaces 1932 with first slots 1946*a-b* may respectively produce a resonance of approximately one quarter wavelength for a low band and harmonics for a high band. In the example shown in FIG. 19, the antenna 1900 also includes second slots 1948*a-b* on the first sides of the antenna holders 1902. The second slot 1948*a-b* loading may produce a resonance of approximately one quarter wavelength and corresponding harmonics for a high band. Other variations of the antenna 1900 are possible.

Figure 20:
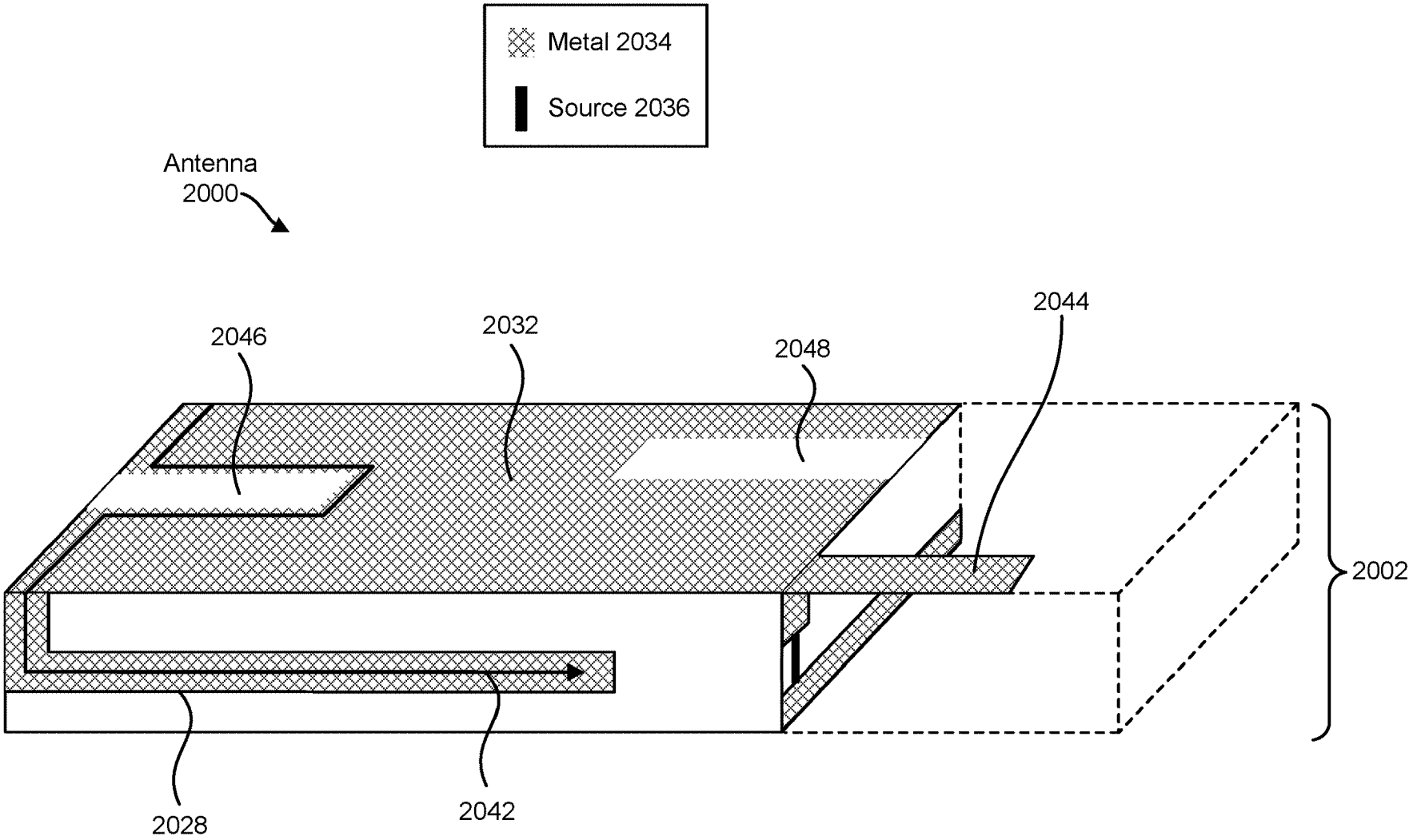
FIG. 20 illustrates a perspective view of an example of an antenna with an extension arm, a monopole, and slots on the first side.

FIG. 20 illustrates a perspective view of an example of an antenna 2000 with an extension arm 2028, a monopole 2044, and slots 2046, 2048 on the first side. The antenna 2000 may be another example of a patch antenna. The antenna 2000 includes some elements as similarly described in FIG. 12. For example, the antenna 2000 includes a parallelepipedal antenna holder 2002, an excitation surface 2032 (e.g., metal patch) situated on the first side of the antenna holder 2002, and/or a grounding surface (e.g., metal wall) situated on the third side as described in FIG. 12. One or more sides of the antenna holder 2002 may be partially or completely covered with metal 2034.

The antenna 2000 may include a direct feed source 2036 or an excitation radiator feed. In FIG. 20, the source 2036 may be coupled to the excitation surface 2032 from the fifth side. The antenna 2000 may be referred to as a monopole-loaded and slot-loaded compact patch antenna with edge feed.

In the example shown in FIG. 20, the antenna 2000 includes an extension arm 2028 of the excitation surface 2032 extending to the fourth side (e.g., the front side) of the antenna holder 2002. In some examples, the extension arm 2028 may be implemented as described in FIG. 12. A first slot 2046 on the first side (e.g., top side) of the antenna holder 1502 and the extension arm 2028 may extend a length 2042 of an edge of the excitation surface originating from the third side (e.g., back side).

The excitation surface 2032 may provide a resonance for a low band. For example, the excitation surface 2032 with the first slot 2046 may produce a resonance of approximately one quarter wavelength for a low band and harmonics for a high band. In the example shown in FIG. 20, the antenna 2000 also includes a second slot 2048 on the first side of the antenna holder 2002. The second slot 2048 may produce a resonance of approximately one quarter wavelength and corresponding harmonics for a high band. The monopole 2044 may produce a resonance of approximately one quarter wavelength and corresponding harmonics for a second high band. Other variations of the antenna 2000 are possible.

Figure 21:
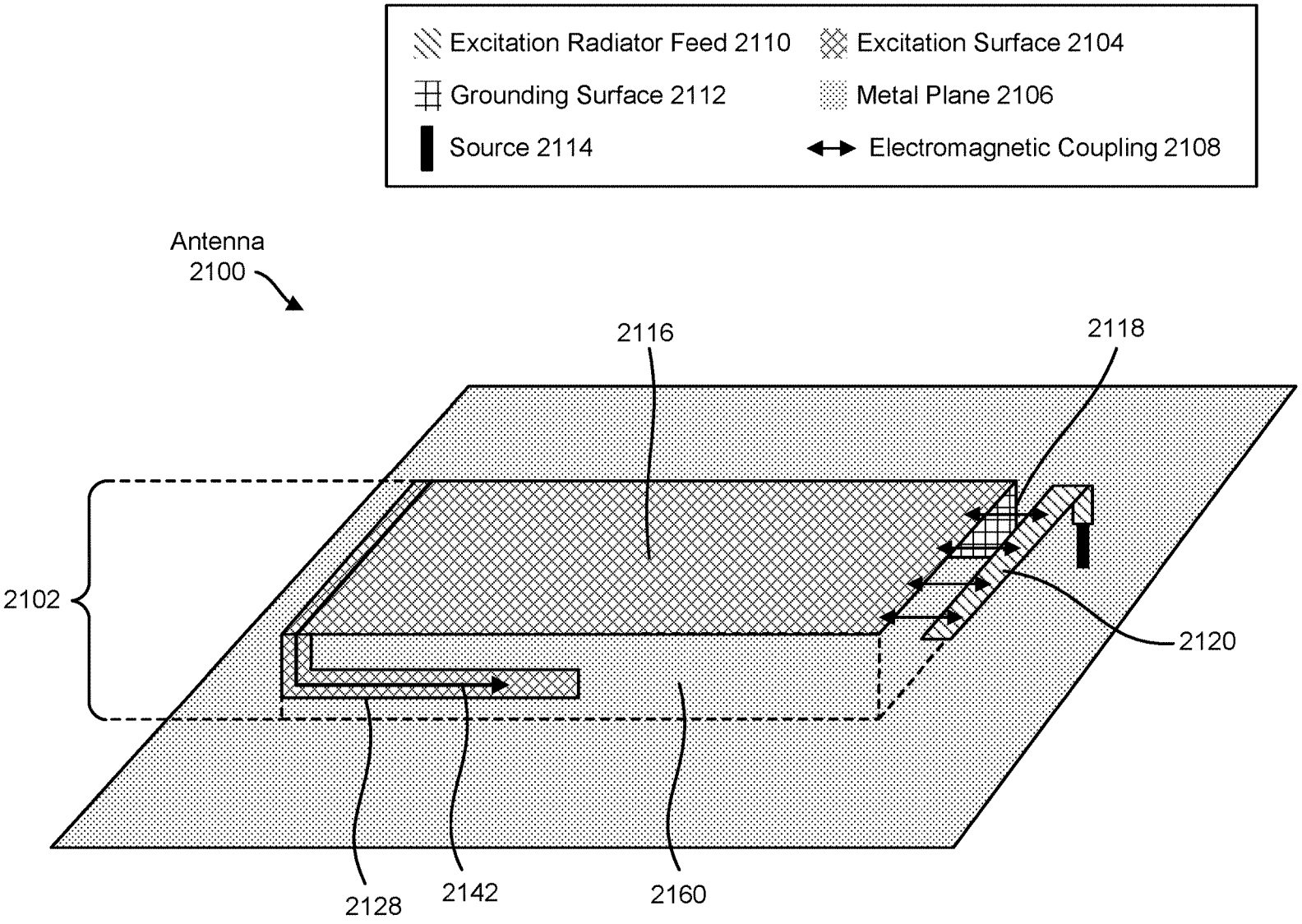
FIG. 21 illustrates a perspective view of an example of an antenna with a monopole excitation radiator feed and an extension arm.

FIG. 21 illustrates a perspective view of an example of an antenna 2100 with a monopole 2120 excitation radiator feed 2110 and an extension arm 2128. The antenna 2100 may be another example of a patch antenna. The antenna 2100 includes some elements as similarly described in FIG. 1 and FIG. 12. For example, the antenna 2100 includes a parallelepipedal antenna holder 2102, an excitation surface 2104 (e.g., metal patch) situated on a first side 2116 of the antenna holder 2102, a second side of the antenna holder 2102 that may be situated on a metal plane 2106, and a grounding surface 2112 (e.g., a metal wall) situated on a third side 2118 as described in FIG. 1 and/or FIG. 12.

The antenna 2100 may include an excitation radiator feed 2110 (e.g., a metal feed strip) situated to provide electromagnetic coupling 2108 between the excitation radiator feed 2110 and the excitation surface 2104. The excitation radiator feed 2110 may be situated next to the excitation surface 2104, and/or may not be in direct contact with the excitation surface 2104. In the example shown in FIG. 21, the excitation radiator feed may be a monopole 2120. The monopole 2120 may be a metal strip. In the example shown in FIG. 21, a first end of the monopole 2120 (e.g., metal feed strip) may be coupled to a source 2114 (e.g., a feeding signal source). All or a portion of the monopole 2120 may be approximately coplanar with the excitation surface 2104. In some examples, the second end of the monopole 2120 may not extend to the metal plane 2106.

In the example shown in FIG. 21, the source 2114 may be coupled to the excitation radiator feed 2110 (e.g., metal feed strip) adjacent to the third side 2118. In some examples, the source 2114 (e.g., feeding signal source) may be fed from a direction adjacent to the grounding surface 2112. In other examples, the source 2114 may be coupled to the excitation radiator feed 2110 adjacent to a fourth side 2160 (e.g., the front side) opposite the third side 2118. Other variations of the antenna 2100 are possible, such as one or more extension arms, one or more slots, one or more additional antenna holders, etc.

Figure 22:
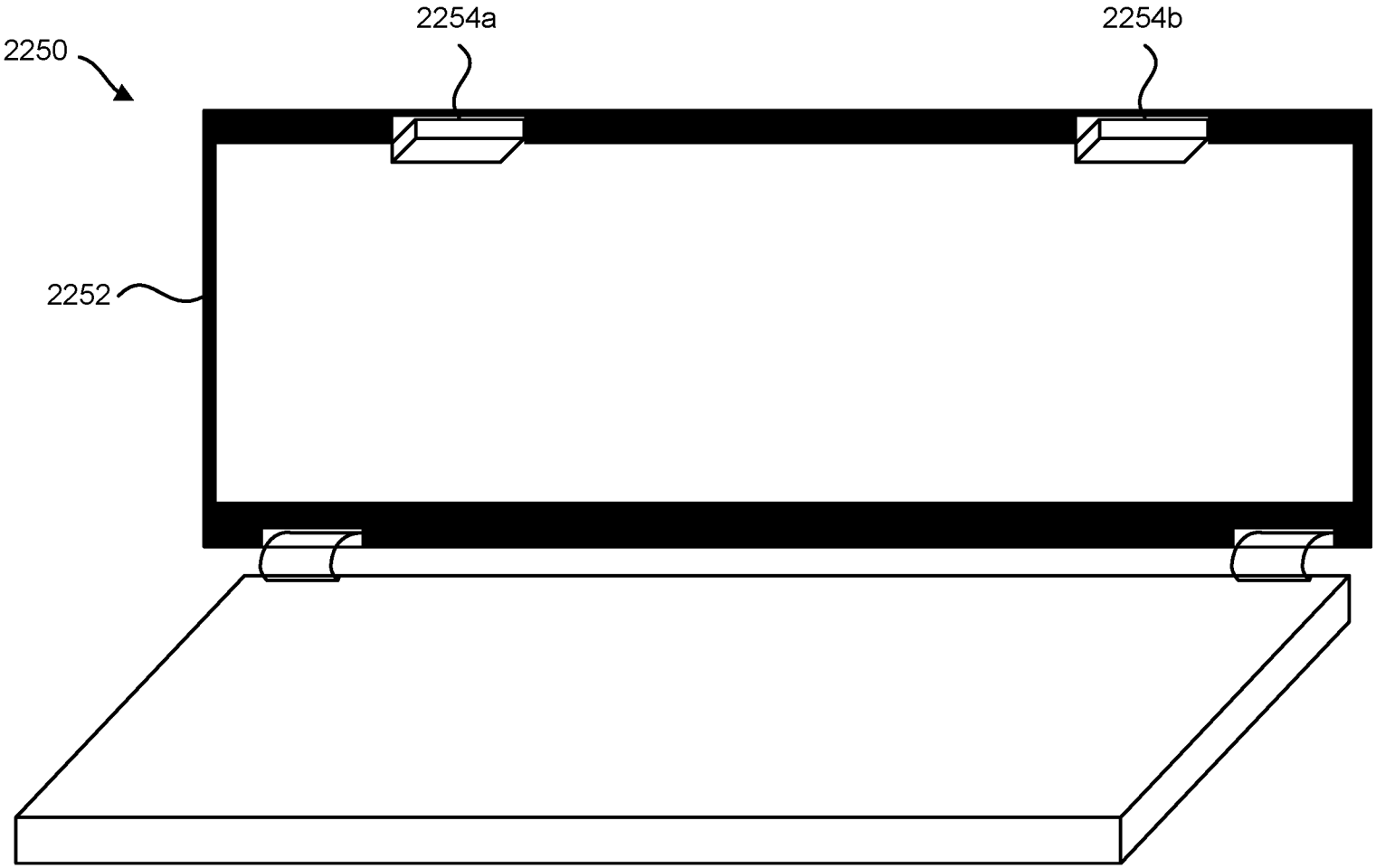
FIG. 22 is a perspective view diagram illustrating an example of antenna placement in an upper portion of a display unit of an electronic device.

FIG. 22 is a perspective view diagram illustrating an example of antenna 2254*a-b* placement in an upper portion of a display unit 2252 of an electronic device 2250. Examples of the electronic device 2250 include laptop computers and hybrid laptop/tablet devices. The base (e.g., frame) of the electronic device 2250 may be metal. In this example, an antenna 2254*a-b* may be positioned at the top of a display unit 2252 (e.g., under the frame and/or display). One or more of the antennas described herein may be positioned as shown in FIG. 22.

Figure 23:
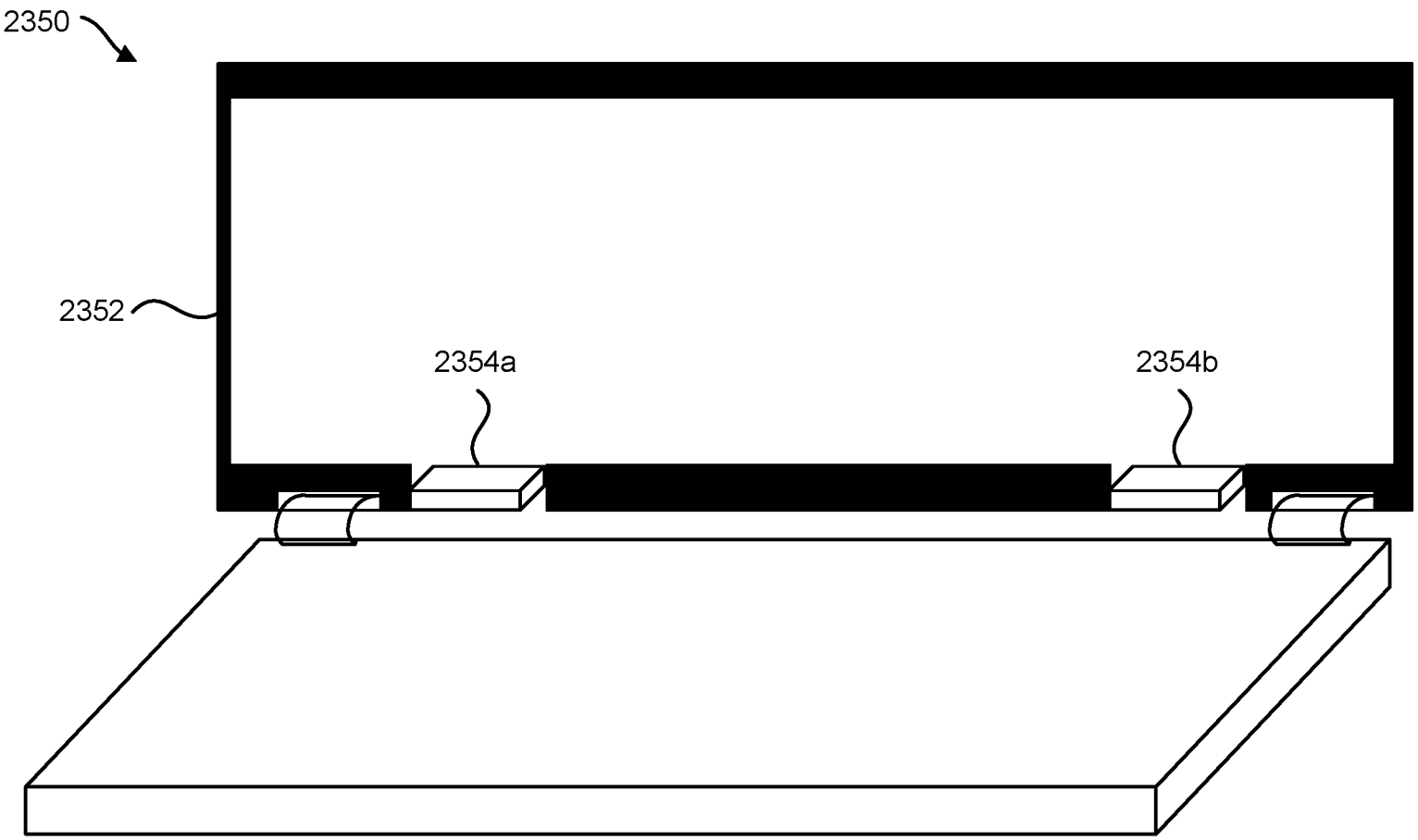
FIG. 23 is a perspective view diagram illustrating an example of antenna placement in a lower portion of a display unit of an electronic device.

FIG. 23 is a perspective view diagram illustrating an example of antenna 2354*a-b* placement in a lower portion of a display unit 2352 of an electronic device 2350. Examples of the electronic device 2350 include laptop computers and hybrid laptop/tablet devices. The base (e.g., frame) of the electronic device 2350 may be metal. In this example, an antenna 2354*a-b* may be positioned at the bottom of a display unit 2352 (e.g., under the frame and/or display) inside a hinge cap. One or more of the antennas described herein may be positioned as shown in FIG. 23.

Figure 24:
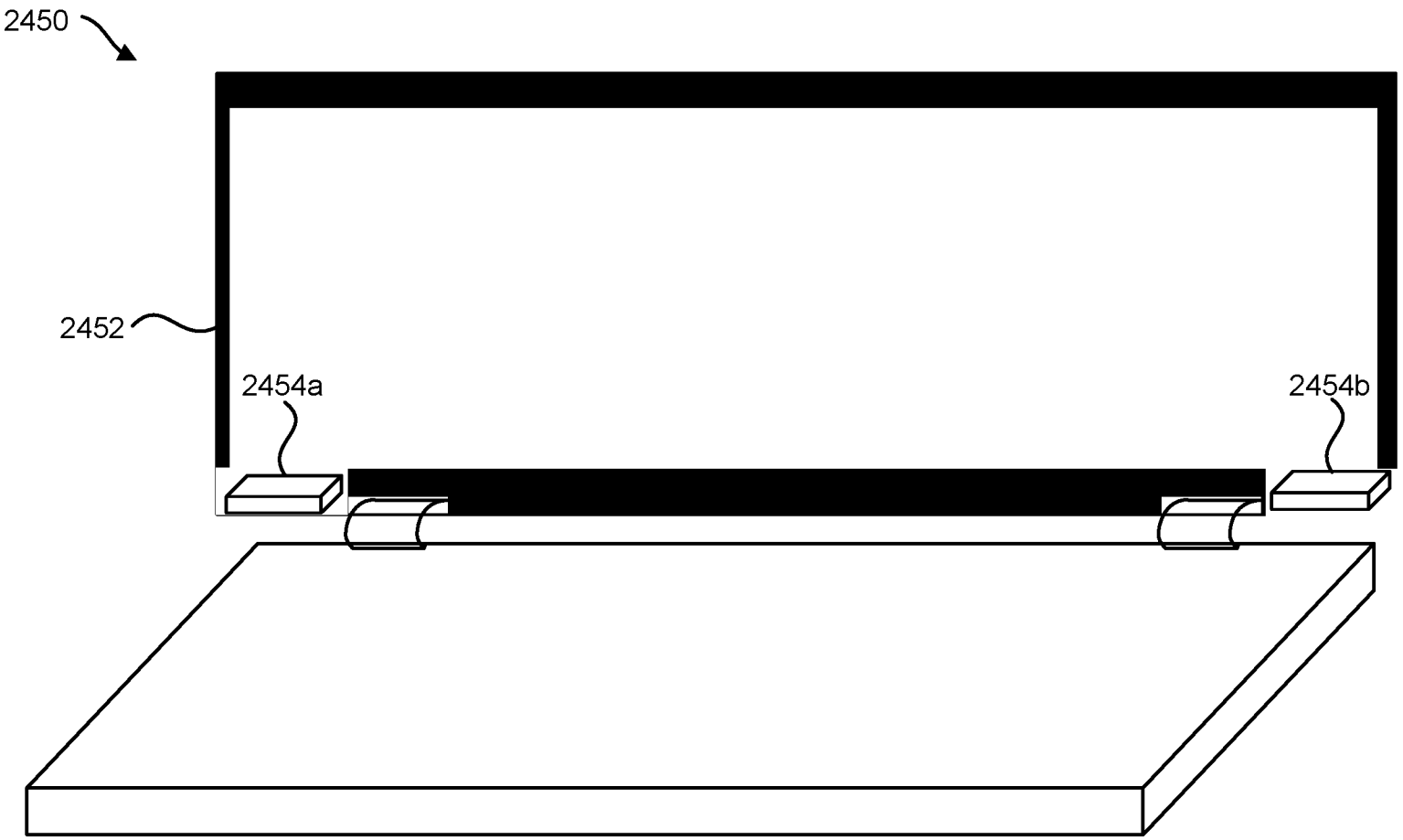
FIG. 24 is a perspective view diagram illustrating an example of antenna placement in a lower portion of a display unit of an electronic device outside the hinge cap.

FIG. 24 is a perspective view diagram illustrating an example of antenna 2454*a-b* placement in a lower portion of a display unit 2452 of an electronic device 2450 outside the hinge cap. Examples of the electronic device 2450 include laptop computers and hybrid laptop/tablet devices. The base (e.g., frame) of the electronic device 2450 may be metal. In this example, an antenna 2454*a-b* may be positioned at the bottom of a display unit 2452 (e.g., under the frame and/or display) outside of the hinge cap. One or more of the antennas described herein may be positioned as shown in FIG. 24.

Figure 25:
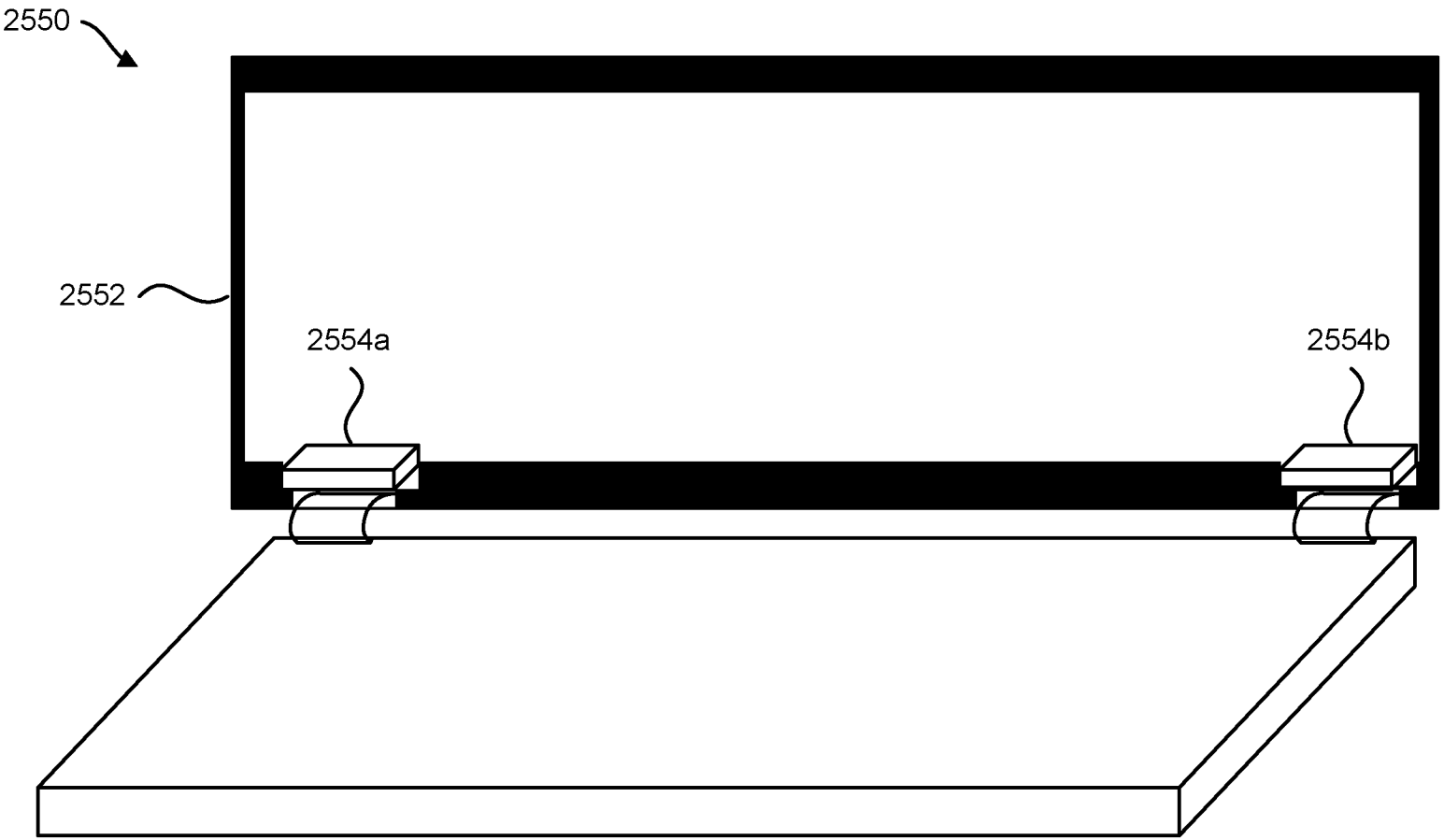
FIG. 25 is a perspective view diagram illustrating an example of antenna placement in a lower portion of a display unit of an electronic device next to the hinge cap.

FIG. 25 is a perspective view diagram illustrating an example of antenna 2554*a-b* placement in a lower portion of a display unit 2552 of an electronic device 2550 next to the hinge cap. Examples of the electronic device 2550 include laptop computers and hybrid laptop/tablet devices. The base (e.g., frame) of the electronic device 2550 may be metal. In this example, an antenna 2554*a-b* may be positioned at the bottom of a display unit 2552 (e.g., under the frame and/or display) next to the hinge cap. One or more of the antennas described herein may be positioned as shown in FIG. 25.

Figure 26:
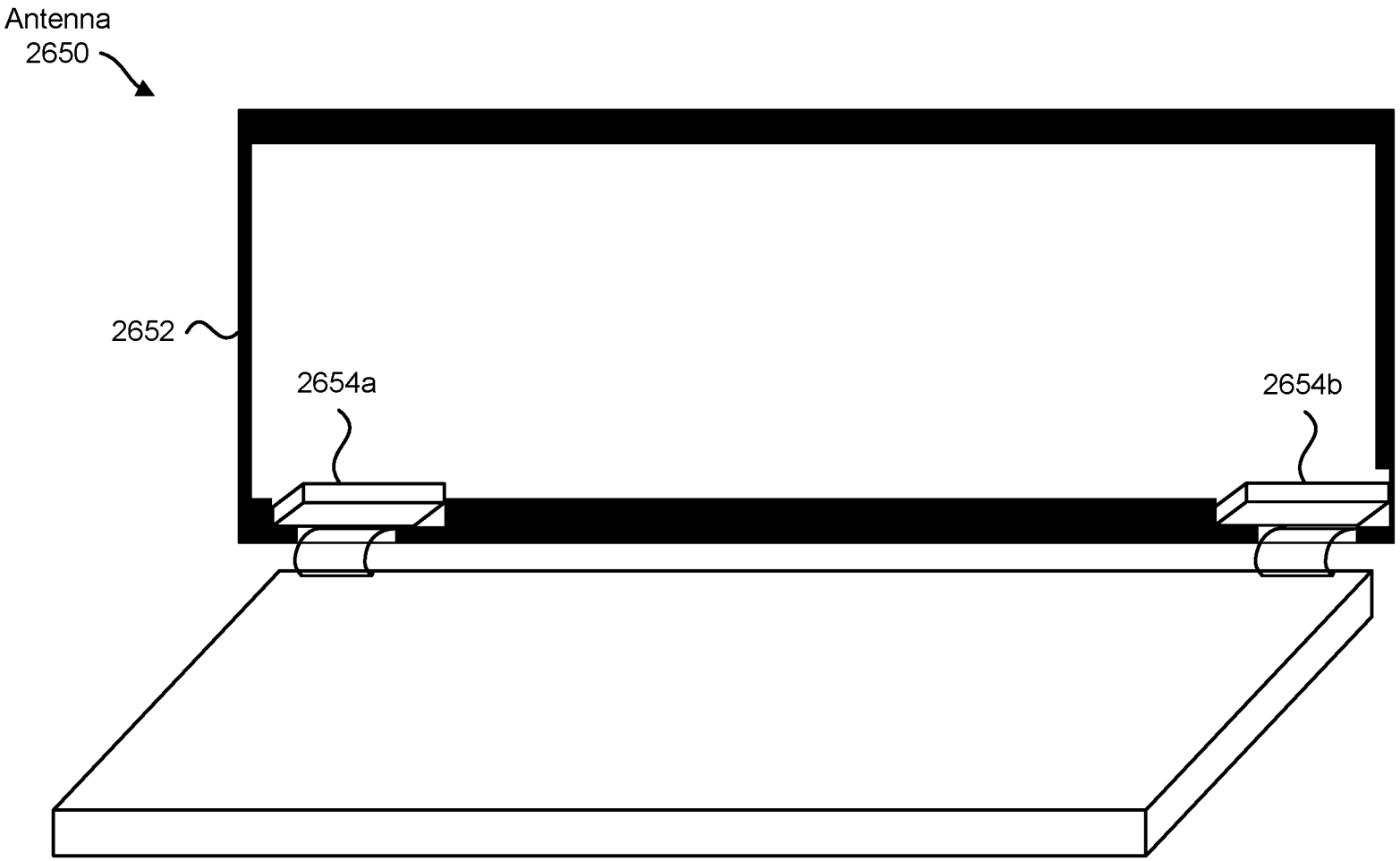
FIG. 26 is a perspective view diagram illustrating an example of antenna placement in a lower portion of a display unit of an electronic device reoriented next to the hinge cap.

FIG. 26 is a perspective view diagram illustrating an example of antenna 2654*a-b* placement in a lower portion of a display unit 2652 of an electronic device 2650 reoriented next to the hinge cap. Examples of the electronic device 2650 include laptop computers and hybrid laptop/tablet devices. The base (e.g., frame) of the electronic device 2650 may be metal. In this example, an antenna 2654*a-b* may be positioned at the bottom of a display unit 2652 (e.g., under the frame and/or display) next to the hinge cap in a reoriented fashion (e.g., facing away). This placement may avoid an edge SAR issue for convertible devices. One or more of the antennas described herein may be positioned as shown in FIG. 26.

Figure 27:
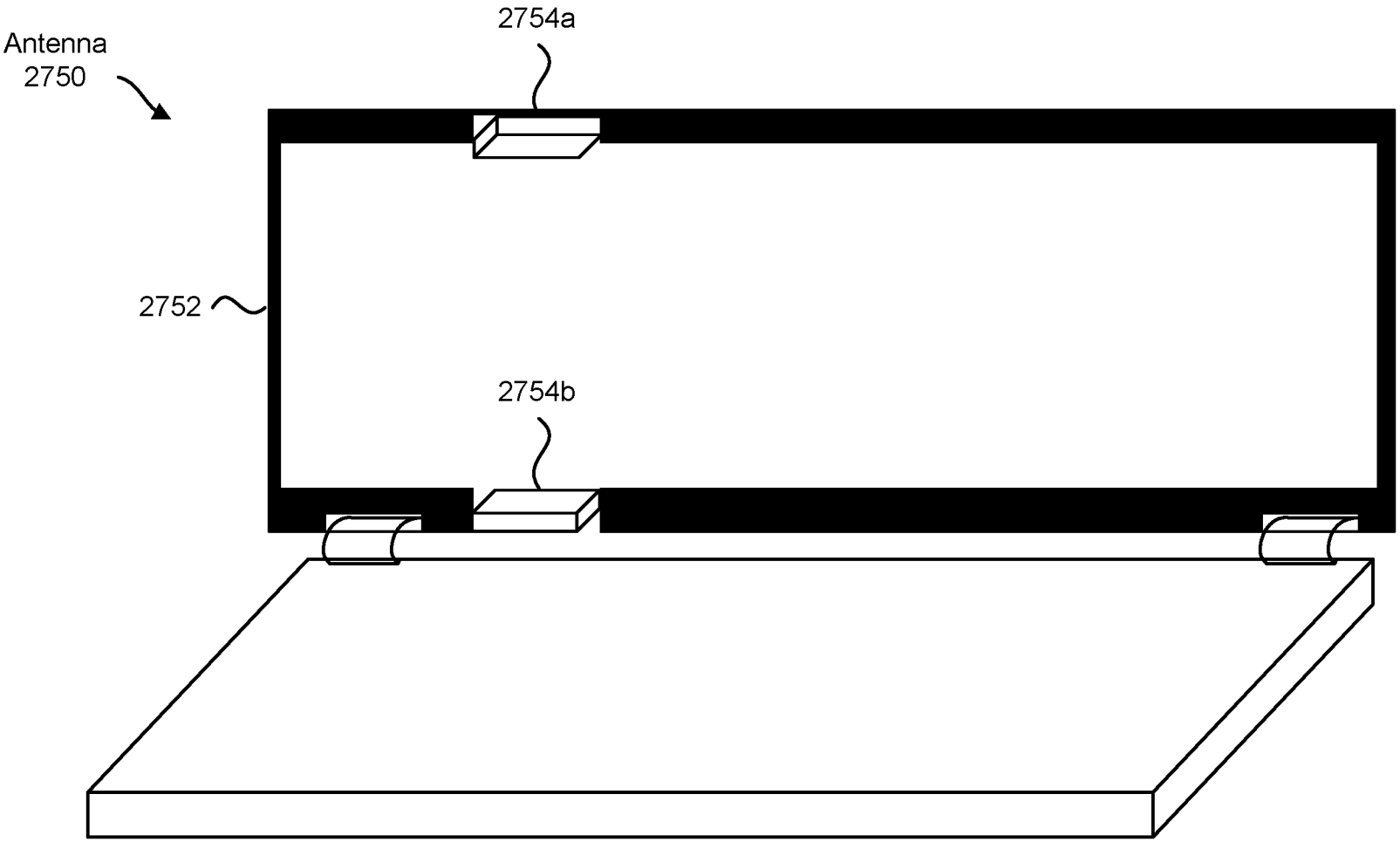
FIG. 27 is a perspective view diagram illustrating an example of antenna placement in an upper portion and lower portion of a display unit of an electronic device.

FIG. 27 is a perspective view diagram illustrating an example of antenna 2754*a-b* placement in an upper portion and lower portion of a display unit 2752 of an electronic device 2750. Examples of the electronic device 2750 include laptop computers and hybrid laptop/tablet devices. The base (e.g., frame) of the electronic device 2750 may be metal. In this example, an antenna 2754*a-b* may be positioned at the top and bottom of a display unit 2752 (e.g., under the frame and/or display). This placement may be implemented for a WLAN dual band antenna separated on the top and bottom of the display unit 2752. One or more of the antennas described herein may be positioned as shown in FIG. 27.

The invention claimed is:

1. A patch antenna, comprising:

a parallelepipedal antenna holder;

an excitation surface situated on a first side of the antenna holder, wherein a second side opposite the first side is situated on a metal plane, wherein the metal plane is a device cover;

a grounding surface situated on a third side between the first side and the second side; and an excitation radiator feed situated to provide electromagnetic coupling between the excitation radiator feed and the excitation surface, wherein a shortest side dimension of the patch antenna is less than a quarter wavelength of a target frequency.

2. The patch antenna of claim 1, wherein the excitation radiator feed is a monopole.

3. The patch antenna of claim 1, wherein the excitation radiator feed is a loop adjacent to the first side, wherien the loop is also adjacent to the third side or a fourth side opposite the third side.

4. The patch antenna of claim 1, wherein a source is coupled to the excitation radiator feed adjacent to the third side.

5. The patch antenna of claim 1, wherein a source is coupled to the excitation radiator feed adjacent to a fourth side opposite the third side.

6. The patch antenna of claim 1, further comrpising an extension arm of the excitation surface that extending onto a fourth side opposite the third side, and extending a length of an edge of the excitation surface originating from the third side.

7. The patch antenna of claim 1, wherein the excitation surface comprises a slot on the edge of the excitation surface originating from the third side.

8. The patch antenna of claim 1, further comrpising:

a second parallelepipedal antenna holder; and a second excitation surface situated on the second parallelepipedal antenna holder to provide electromagnetic coupling between the excitation radiator feed and the second excitation surface, wherein the second excitation surface is arranged in a cascading surface relative to the sexcitation surface.

9. An antenna, comprising:

a cuboid substrate;

a metal patch on a first side of the substrate, wherein the substrate is positioned on a metal surface, wherein the metal surface is a device cover, and wherein the metal patch is grounded by a metal wall between the first side and the metal surface; and a metal feed strip electromagnetically coupled to the metal patch, wherein a shortest side dimension of the antenna is less than a quarter wavelength of a target frequency.

10. The antenna of claim 9, wherein a first end of the metal feed strip is coupled to a source and a second end of the metal feed strip is separate from the metal surface.

11. The antenna of claim 9, wherein a first end of the metal feed strip is coupled to a source and a second end of the metal feed strip loops to the metal surface.

12. The antenna of claim 9, wherein a source is coupled to the metal feed strip next to the metal wall.

13. The antenna of claim 9, wherein a source is coupled to the metal feed strip next to a side opposite metal wall.

14. The antenna of claim 9, further comprising a metal strip to extend an edge of the metal patch onto a side of the cuboid substrate opposite the metal wall, wherein the metal strip is to wrap over a vertex of the cuboid substrate.

15. The antenna of claim 9, wherein the metal patch comprises a slot on an edge of the metal patch originating from the third side of the substrate.

* * * * *